US010303103B2

(12) United States Patent
Akita

(10) Patent No.: US 10,303,103 B2
(45) Date of Patent: May 28, 2019

(54) IMAGE FORMING APPARATUS

(71) Applicant: CANON KABUSHIKI KAISHA, Tokyo (JP)

(72) Inventor: Masanori Akita, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/352,936

(22) Filed: Nov. 16, 2016

(65) Prior Publication Data

US 2017/0068198 A1 Mar. 9, 2017

Related U.S. Application Data

(63) Continuation of application No. PCT/JP2015/065487, filed on May 22, 2015.

(30) Foreign Application Priority Data

May 23, 2014 (JP) ..... 2014-107573

(51) Int. Cl.
*G03G 15/00* (2006.01)
*G03G 15/08* (2006.01)
*G03G 21/00* (2006.01)

(52) U.S. Cl.
CPC ..... *G03G 15/556* (2013.01); *G03G 15/08* (2013.01); *G03G 15/0844* (2013.01); *G03G 21/00* (2013.01)

(58) Field of Classification Search
CPC ..... G03G 15/556; G03G 15/0844
See application file for complete search history.

(56) References Cited

U.S. PATENT DOCUMENTS 7,672,602 B2 3/2010 Ariizumi et al.
7,826,757 B2 11/2010 Akita
(Continued)

FOREIGN PATENT DOCUMENTS

CN 101303540 A 11/2008
CN 102004414 A 4/2011
(Continued)

OTHER PUBLICATIONS

Machine translation of JP 2012-103317. May 31, 2012.*
(Continued)

*Primary Examiner* — Carla J Therrien
(74) *Attorney, Agent, or Firm* — Venable LLP

(57) ABSTRACT

An image forming apparatus includes an image bearing member, a developing device, and a controller capable of executing an operation in a forced consumption mode in which toner is consumed without being transferred onto a recording material. The controller includes a difference calculating portion configured to calculate a difference between an image amount of a predetermined image forming number and a reference value. The reference value is set i) at a first reference value when information on an average image amount per predetermined image forming number or per predetermined driving time of the developing device is less than a value corresponding to a predetermined reference image amount, and is set ii) at a second reference value lower than the first reference value when the information on the average image amount is not less than a predetermined reference image amount.

32 Claims, 21 Drawing Sheets

(56) References Cited

U.S. PATENT DOCUMENTS

| | | | | |
|---|---|---|---|---|
| 7,835,652 | B2 | 11/2010 | Konishi et al. | |
| 8,401,406 | B2 | 3/2013 | Nose | |
| 9,280,085 | B2 | 3/2016 | Nose | |
| 9,304,446 | B2 | 4/2016 | Akita et al. | |
| 9,829,845 | B2 | 11/2017 | Nose | |
| 2011/0052220 | A1* | 3/2011 | Nose | G03G 15/0844 399/27 |
| 2013/0164005 | A1* | 6/2013 | Nose | G03G 15/0844 399/44 |
| 2014/0294407 | A1* | 10/2014 | Mugita | G03G 15/065 399/43 |
| 2015/0248097 | A1* | 9/2015 | Nose | G03G 15/556 399/27 |
| 2016/0085197 | A1* | 3/2016 | Akita | G03G 15/0844 399/27 |
| 2016/0170357 | A1* | 6/2016 | Saito | G03G 15/0844 399/27 |
| 2016/0170360 | A1 | 6/2016 | Nose | |

FOREIGN PATENT DOCUMENTS

| | | | |
|---|---|---|---|
| JP | 2006-23327 | A | 1/2006 |
| JP | 2007-133122 | A | 5/2007 |
| JP | 2008-203731 | A | 9/2008 |
| JP | 2010-224132 | A | 10/2010 |
| JP | 2011-48083 | A | 3/2011 |
| JP | 2011-118148 | A | 6/2011 |
| JP | 2012-73547 | A | 4/2012 |
| JP | 2012-103317 | A | 5/2012 |
| JP | 2013-50611 | A | 3/2013 |
| JP | 2014-6287 | A | 1/2014 |

OTHER PUBLICATIONS

Machine translation of JP 2008-203731. Sep. 4, 2008.*

PCT International Search Report and the Written Opinion dated Aug. 25, 2015, in PCT/JP2015/065487.

Chinese Office Action dated Nov. 1, 2018, in corresponding Chinese Patent Application No. 201580026887.4 (with English translation).

* cited by examiner

<EMB. 1>

| | COLOR | | | |
|---|---|---|---|---|
| | Y | M | C | K |
| PRINT RATIO (%) | 5 | 5 | 5 | 1.5 |
| VIDEO COUNT : V | 26 | 26 | 26 | 8 |
| THRESHOLD VIDEO COUNT : Vt | 5 | 5 | 5 | 5→10 |
| Vt−V | −21 | −21 | −21 | −3→+2 |
| INTEGRATED VALUE : X | 0 | 0 | 0 | 0→+2 |

Fig. 14

< EMB. 2 >

| | COLOR | | | |
|---|---|---|---|---|
| | Y | M | C | K |
| PRINT RATIO (%) | 5 | 5 | 5 | 0.5 |
| VIDEO COUNT : V | 26 | 26 | 26 | 3 |
| THRESHOLD VIDEO COUNT : Vt | 5 | 5 | 5 | 5→10 |
| Vt−V | −21 | −21 | −21 | +2→+7 |
| INTEGRATED VALUE : X | 0 | 0 | 0 | +2→+7 |

Fig. 16

<EMB.3>

| | COLOR | | | | | |
|---|---|---|---|---|---|---|
| | Y | M | C | K① | K② | K③ |
| PRINT RATIO (%) | 5 | 5 | 5 | 1.5 | 10 | 1.5 |
| VIDEO COUNT : V | 26 | 26 | 26 | 8 | 51 | 8 |
| THRESHOLD VIDEO COUNT : Vt | 5 | 5 | 5 | 5 | 5 | 5 |
| Vt−V | −21 | −21 | −21 | −3 | −46 | −3 |
| INTEGRATED VALUE : X | 0 | 0 | 0 | 0 | 0 | 0 |

Fig. 18

IMAGE FORMING APPARATUS

This application is a continuation of PCT Application No. PCT/JP2015/065487, filed on May 22, 2015.

TECHNICAL FIELD

The present invention relates to an image forming apparatus, such as a copying machine, a printer, a facsimile machine or a multi-function machine having a plurality of functions of these machines. Particularly, the present invention relates to a constitution having a forced consumption mode in which a developer is forcedly consumed.

BACKGROUND ART

Generally, in the image forming apparatus of an electrophotographic type, when a proportion in which an image having a low image ratio (print ratio) is formed is large, a proportion of a toner transferred from a developing sleeve in a developing device onto a photosensitive drum becomes small. In such a state, when the developing device is continuously driven for a long time, toner deterioration generates, and therefore an image defect such as toner scattering or fog is liable to occur. For this reason, an operation in which the toner is forcedly consumed by the developing device has been conventionally performed.

For example, in the case where a value as an index of an amount of the developer used every image formation is smaller than a set reference developer amount, a difference between the value and the set reference developer amount is calculated, and when an integrated value obtained by integrating the calculated difference reaches a predetermined value forced consumption of the toner is executed. Such invention has been proposed (Japanese Laid-Open Patent Application 2006-23327). In the case of the invention described in Japanese Laid-Open Patent Application 2006-23327, the reference developer amount is fixed at a print ratio of 5%.

SUMMARY OF THE INVENTION

Problems to be Solved by the Invention

As in the invention described in Japanese Laid-Open Patent Application 2006-23327, in the case where the reference developer amount is fixed, there is a possibility that the execution of forced consumption of the toner does not depend on a degree of toner deterioration in some condition. For example, immediately after a new developing device is installed or after images with a high print ratio are outputted in a large amount deterioration of the toner in the developing device does not progress. Even in a state in which the developer for which such deterioration does not progress occupies most of the developer, in the case of the invention of cited document 1 (Japanese Laid-Open Patent Application 2006-23327), when images with a low print ratio are continuously formed, forced toner consumption is executed. Further, in this case, although the degree of toner deterioration does not progress, forced toner discharge is executed more than necessary and is not preferable.

In view of these circumstances, the present invention has been accomplished for realizing a constitution capable of properly effecting forced consumption of the toner depending on toner deterioration even immediately after the new developing device is installed or after the images with the high print ratio are outputted in a large amount.

Means for Solving the Problem

According to an aspect of the present invention, there is provided an image forming apparatus comprising: an image bearing member; a developing device configured to develop, with toner, an electrostatic latent image formed on the image bearing member; and a controller capable of executing an operation in a forced consumption mode in which the toner with which the electrostatic latent image is developed on the image bearing member by the developing device is consumed without being transferred onto a recording material, wherein the controller includes a difference calculating portion configured to calculate a difference between a consumption amount depending on an amount of the toner consumed every predetermined unit image formation and a reference value set for the predetermined unit image formation, an integrating portion configured to integrate the difference to acquire an integrated value, and an executing portion configured to execute the operation in the forced consumption mode when the integrated value is larger than a predetermined threshold, and wherein the reference value is set at a first reference value when information on an average toner consumption amount per predetermined sheet number or per predetermined driving time of the developing device and is less than a value corresponding to a predetermined reference toner consumption amount and is set at a second reference value lower than the first reference value when the information on the average toner consumption amount is not less than the predetermined reference toner consumption amount.

According to the present invention, even immediately after the new developing device is installed or after the images with the high print ratio are outputted in a large amount, the forced consumption of the toner can be properly effected depending on the toner deterioration.

BRIEF DESCRIPTION OF THE DRAWINGS

FIG. 14 is a diagram for illustrating Embodiment 1 according to the First Embodiment.

FIG. 16 is a diagram for illustrating Embodiment 2 according to the First Embodiment.

FIG. 18 is a diagram for illustrating Embodiment 3 according to the First Embodiment.

EMBODIMENTS FOR CARRYING OUT THE INVENTION

First Embodiment

The First Embodiment of the present invention will be described with reference to FIGS. 1-13. First, a general structure of an image forming apparatus in this embodiment will be described with reference to FIGS. 1-3.

[Image Forming Apparatus]

Figure 1:
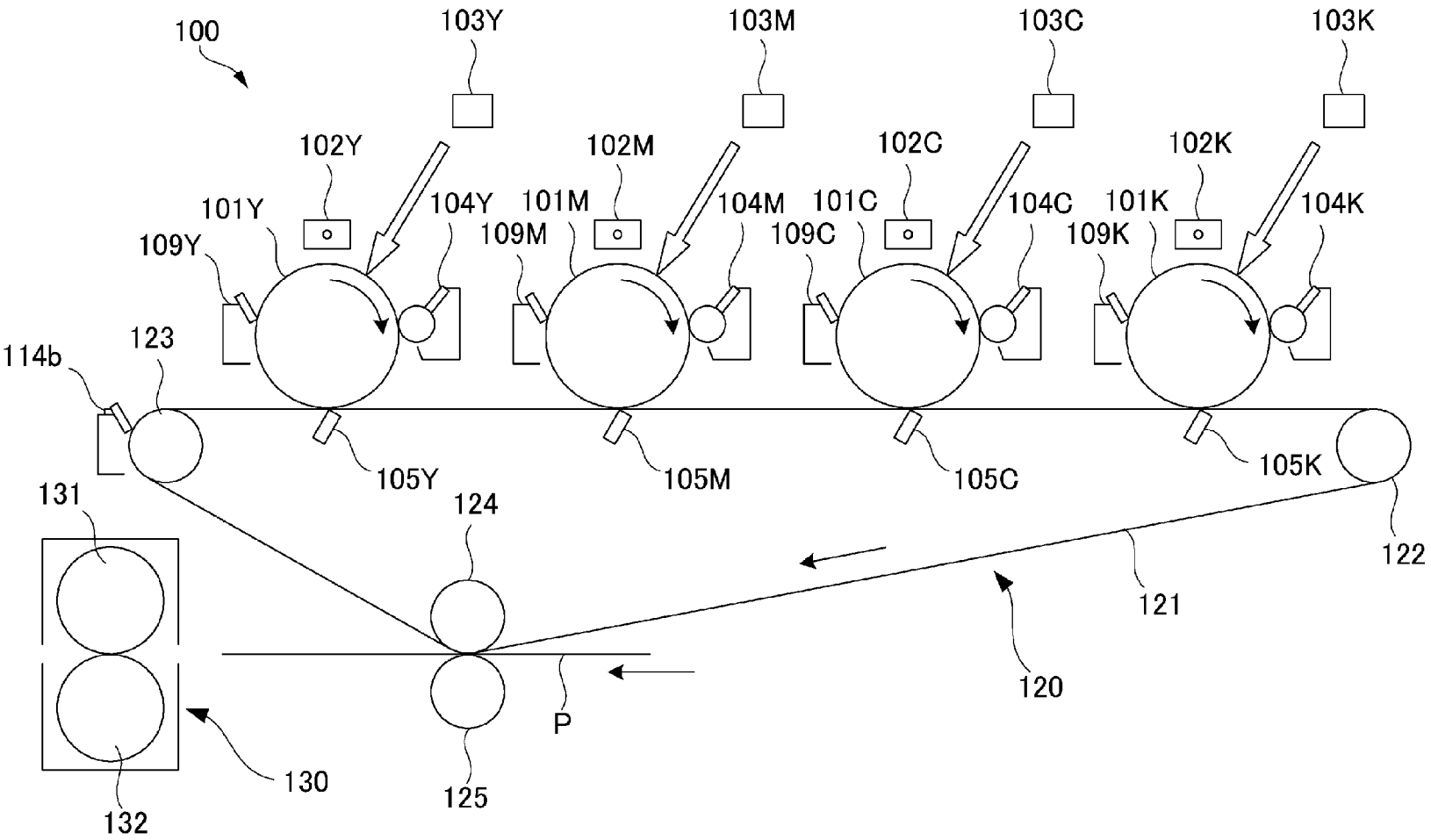
FIG. 1 is a schematic structural view of an image forming apparatus according to a First Embodiment of the present invention.
Figure 2:
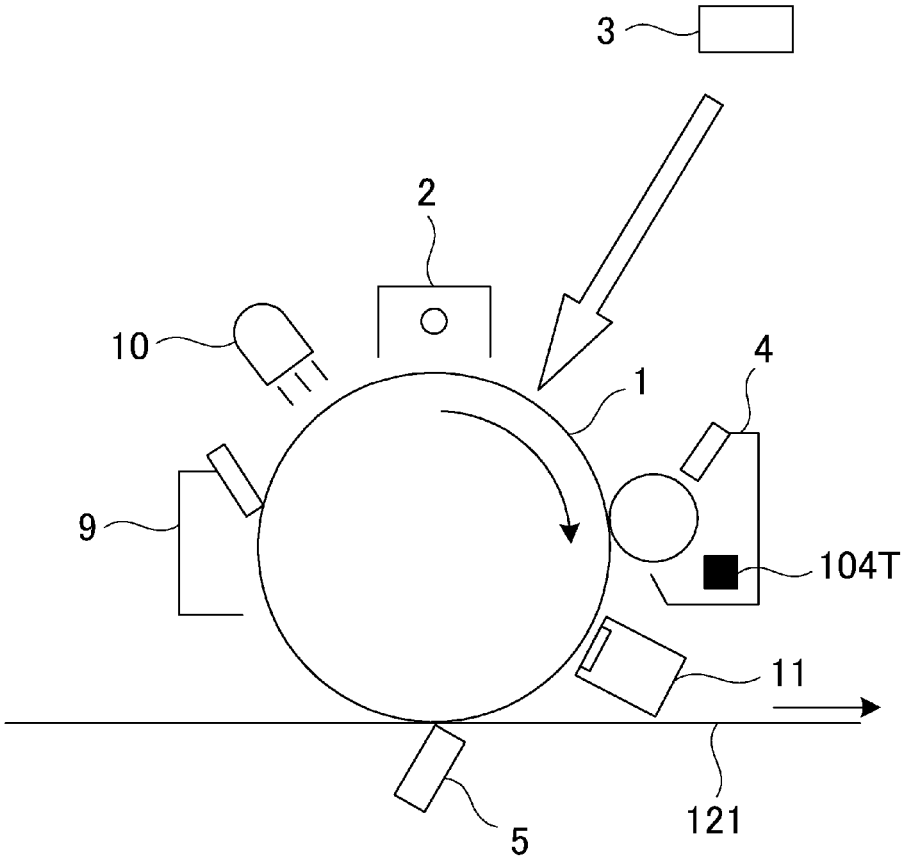
FIG. 2 is a schematic structural view of an image forming station in the First Embodiment.

As shown in FIG. 1, an image forming apparatus 100 in this embodiment includes four image forming stations Y, M, C and K provided with photosensitive drums 101 (101Y, 101M, 101C and 101K) as image bearing members. On each of the image forming stations, an intermediary transfer device 120 is provided. The intermediary transfer device 120 is constituted so that an intermediary transfer belt 121 as an intermediary transfer member is stretched by rollers 122, 123 and 124 and is moved in a direction indicated by arrows.

At peripheries of the photosensitive drums 101, primary charging devices 102 (102Y, 102M, 102C and 102K), developing devices 104 (104Y, 104M, 104C and 104K), cleaners 109 (109Y, 109M, 109C and 109K) and the like are provided. Constitutions and an image forming operation at the peripheries of the photosensitive drums will be described with reference to FIGS. 1 and 2. The constitutions around the photosensitive drums for the respective colors are similar to each other, and therefore in the case where there is no need to particularly distinguish the constitutions, suffixes representing the constitutions of the image forming stations for the respective colors will be omitted from description.

The photosensitive drum 101 is rotationally driven in an arrow direction. The surface of the photosensitive drum 101 is electrically charged uniformly by the primary charging device 102 of a non-control charging type (corona type). The charged surface of the photosensitive drum 1 is exposed to light by a laser emitting device 103 as an exposure device, so that an electrostatic latent image is formed. The thus-formed electrostatic latent image is visualized with toner by the developing device 104, so that a toner image is formed on the photosensitive drum 101. At the image forming stations, the toner images of yellow (Y), magenta (M), cyan (C) and black (K) are formed, respectively.

The toner images formed at the respective image forming stations are transferred and superposed on the intermediary transfer belt 121 of polyimide resin by a transfer bias with the primary transfer blades 105 (105Y, 105M, 105C and 105K). The four-color toner images formed on the intermediary transfer belt 121 are transferred onto recording material (e.g., a sheet material such as a sheet or an OHP sheet) P by a secondary transfer roller 125 as a secondary transfer means disposed opposite to the roller 124. The toner remaining on the intermediary transfer belt 121 without being transferred onto the recording material P is removed by an intermediary transfer belt cleaner 114*b*. The recording material P on which the toner images are transferred is pressed and heated by a fixing device 130 including fixing rollers 131 and 132, so that the toner image is fixed. Further, primary transfer residual toners remaining on the photosensitive drums 101 after the primary transfer are removed by cleaners 109, and further a potential on the photosensitive drum 101 is erased (eliminated) by a pre-exposure lamp 10, and the photosensitive drum 101 is subjected to the image formation again. Further, in the developing device 4, as a temperature detecting means of the developer in the developing device 4, a temperature sensor 104T is provided.

Figure 3:
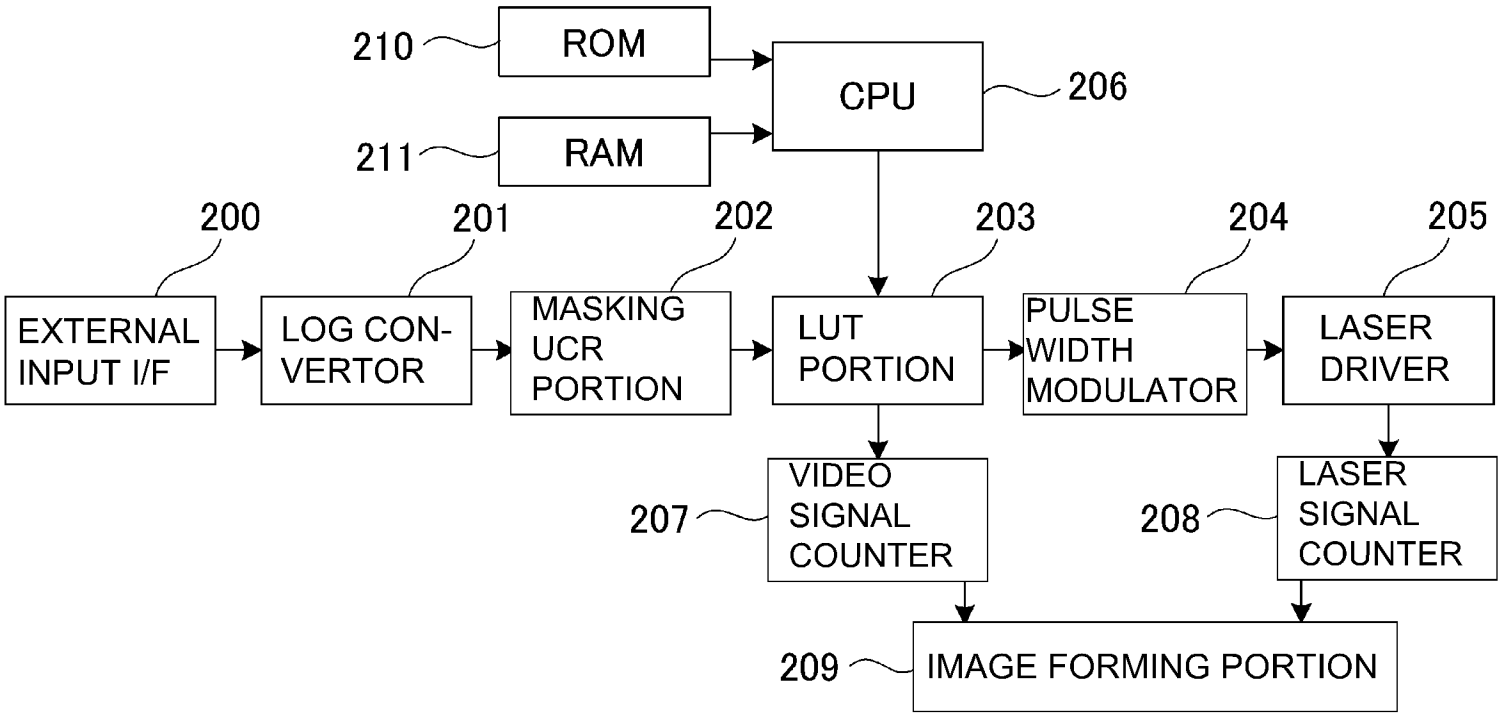
FIG. 3 is a block diagram showing a system constitution of the image forming apparatus in the First Embodiment.

Next, a system constitution of an image processing unit in the image forming apparatus 100 in this embodiment will be described with reference to FIG. 3. In FIG. 3, through an external input interface (I/F) 200, color image data as RGB image data are inputted from an unshown external device such as an original scanner or a computer (information processing device) as desired. 201 is a LOG conversion portion and converts luminance data of the input RGB image data into CMY density data (CMY image data) on the basis of a look-up table constituted (prepared) by data or the like stored in an ROM 210. 202 is a masking UCR portion and extracts a black (K) component data from the CMY image data and subjects CMYK image data to matrix operation in order to correct color shading of a recording colorant. 203 is a look-up table portion (LUT portion) and makes density correction of the input CMYK image data every color by using a gamma (γ) look-up table in order that the image data are caused to coincide with an ideal gradation characteristic of a printer portion. Incidentally, the γ look-up table is prepared on the basis of the data developed on an RAM 211 and the contents of the table are set by a CPU 206. 204 is a pulse width modulation portion and outputs a pulse signal with a pulse width corresponding to image data (image signal) input from the LUT portion 203. On the basis of this pulse signal, a laser driver 205 drives the laser emitting element 103 to irradiate the surface of the photosensitive drum 101 with laser light, so that the electrostatic latent image is formed on the photosensitive drum 101.

A video signal counting portion 207 adds up a level for each pixel (0 to 255 level) for a screenful of the image (with respect to 600 dpi in this embodiment) of the image data input into the LUT portion 203. The integrated value of the image data is referred to as a video count value. A maximum of this video count value is 1023 in the case where all the pixels for the output image are at the 255 level. Incidentally, when there is a restriction on the constitution of the circuit, by using a laser signal count portion 208 in place of the video signal counting portion 207, the image signal from the laser drive 205 is similarly calculated, so that it is possible to obtain the video count value.

[Developing Device]

Figure 4:
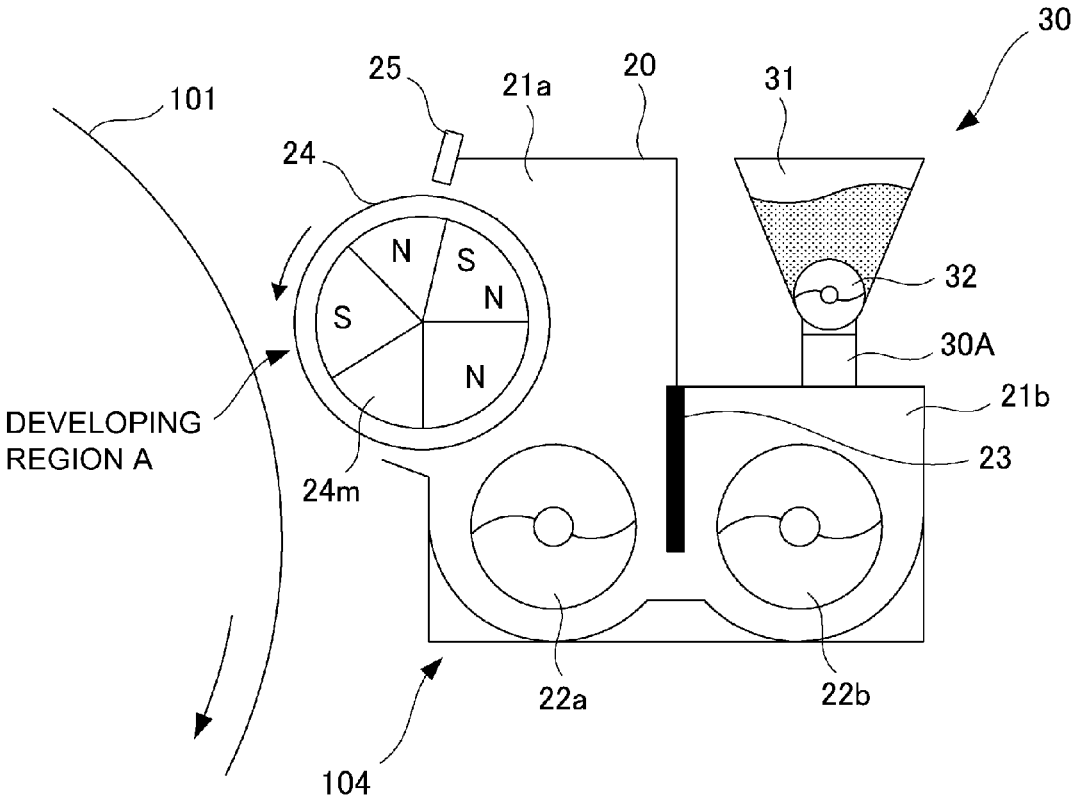
FIG. 4 is a schematic cross-sectional structural view of a developing device in the First Embodiment.
Figure 5:
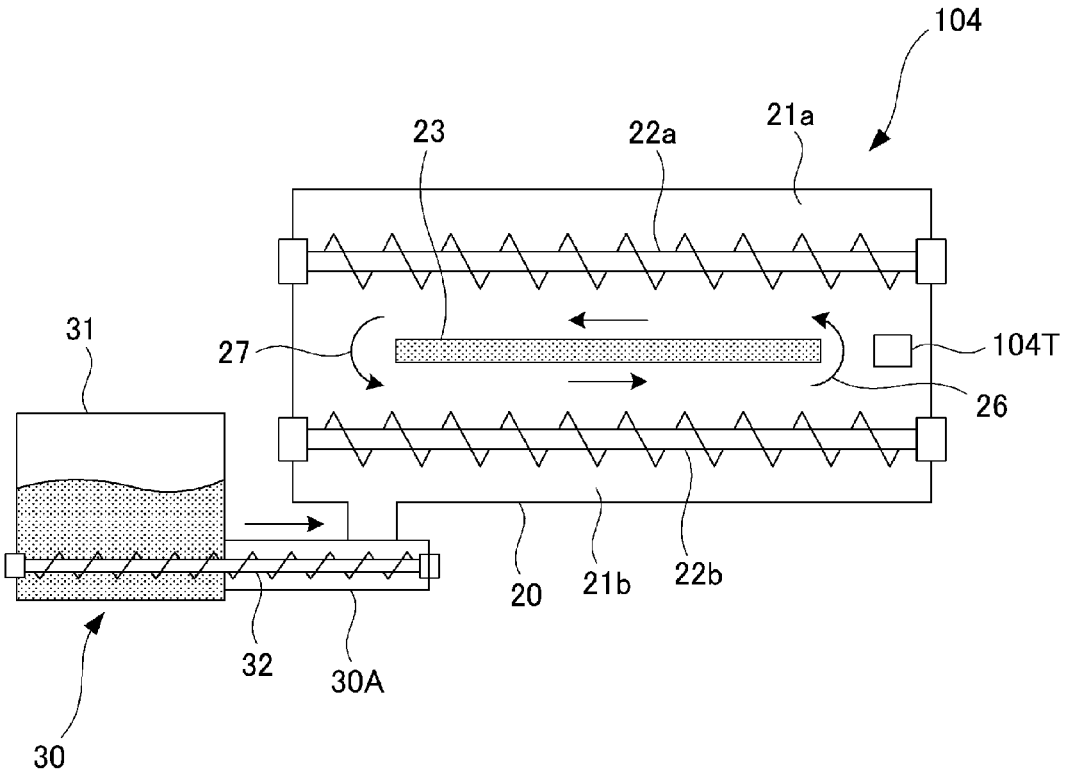
FIG. 5 is a schematic longitudinal sectional structural view of the developing device in the First Embodiment.
Figure 6:
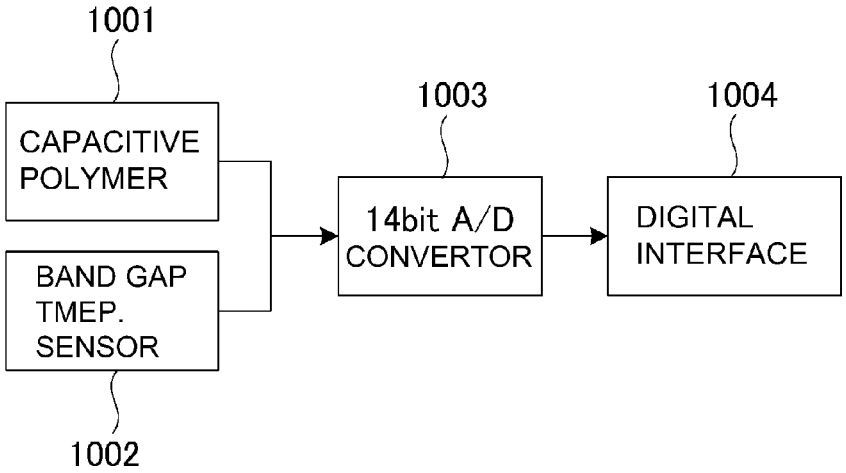
FIG. 6 is a control block diagram of a temperature sensor provided in the developing device in the First Embodiment.

Next, the developing device 104 in this embodiment will be further described specifically with reference to FIGS. 4-6. The developing device 104 in this embodiment includes a developing container 20, in which a two-component developer including toner and a carrier is stored. The developing device 104 also includes a developing sleeve 24 as a developer carrying member and a trimming member 25 for regulating a magnetic brush chain formed of the developer carried on the developing sleeve 24, in the developing container 20.

The inside of the developing container 20 is horizontally divided by a partition wall 23 into a developing chamber 21*a* and a stirring chamber 21*b*. The partition wall 23 extends in the direction perpendicular to the drawing sheet surface of FIG. 4. The developer is stored in the developing chamber 21*a* and the stirring chamber 21*b*. In the developing chamber 21*a* and the stirring chamber 21*b*, first and second feeding screws 22*a* and 22*b* which are feeding members as developer stirring and feeding means are disposed, respectively. As shown in FIG. 5, the first feeding screw 22*a* is disposed, at the bottom portion of the developing chamber 21*a*, roughly in parallel to the axial direction of the developing sleeve 24. It conveys the developer in the developing chamber 21*a* in one direction parallel to the axial line of the developing sleeve 24 by being rotated. The second feeding screw 22*b* is disposed, at the bottom portion of the stirring chamber 21*b*, roughly in parallel to the first feeding screw 22*a*. It conveys the developer in the stirring chamber 21*b* in the direction opposite to that of the first feeding screw 22*a*.

Thus, by the feeding of the developer through the rotation of the first and second feeding screws 22*a* and 22*b*, the developer is circulated between the developing chamber 21*a* and the stirring member 21*b* through openings 26 and 27 (that is, communicating portions) present at both ends of the partition wall 23 (see, FIG. 5). In this embodiment, the developing chamber 21*a* and the stirring chamber 21*b* are horizontally disposed. However, the present invention is also applicable to a developing device in which the developing chamber 21*a* and the stirring chamber 21*b* are vertically disposed and developing devices of other types.

The developing container 20 is provided with an opening at a position corresponding to a developing region A wherein the developing container 20 opposes the photosensitive drum 101. At this opening, the developing sleeve 24 is rotatably disposed so as to be partially exposed toward the photosensitive drum 101. In this embodiment, the diameter of the developing sleeve 24 is 20 mm and the diameter of the photosensitive drum 101 is 80 mm, and a distance in the closest area between the developing sleeve 24 and the photosensitive drum 101 is about 400 μm. By this constitution, development can be effected in a state in which the developer fed to a developing region A is brought into contact with the photosensitive drum 101. Incidentally, the developing sleeve 24 is formed of nonmagnetic material such as aluminum and stainless steel and inside thereof a magnetic roller 24*m* as a magnetic field generating means is non-rotationally disposed.

In the constitution described above, the developing sleeve 24 is rotated in the direction indicated by an arrow (counterclockwise direction) to carry the two component developer regulated in its layer thickness by cutting of the chain of the magnetic brush with the trimming member 25. Then, the developing sleeve 24 conveys the layer thickness-regulated developer to the developing region A in which the developing sleeve 24 opposes the photosensitive drum 101, and supplies the developer to the electrostatic latent image formed on the photosensitive drum 101, thus developing the latent image. At this time, in order to improve development efficiency, i.e., a rate of the toner imparted to the latent image, a developing bias voltage in the form of a DC voltage biased or superposed with an AC voltage is applied to the developing sleeve 24 from a power source. In this embodiment, the developing bias is a combination of a DC voltage of −500 V, and an AC voltage which is 1,800 V in peak-to-peak voltage Vpp and 12 kHz in frequency f. However, the DC voltage value and the AC voltage waveform are not limited to those described above.

Incidentally, in this embodiment, a potential difference between the above-described DC voltage value and an exposed portion potential (i.e., a solid portion potential) by the laser light emitting element 103 is controlled so that the toner amount per unit area on the photosensitive drum 101 during solid image formation is 0.7 mg/cm$^2$. Here, the solid image is a toner image formed on an entire surface of the photosensitive drum 101 in an image formable region, and refers to the case where an image ratio (print ratio) is 100%. Further, in the two-component magnetic brush developing method, generally, the application of AC voltage increases the development efficiency and therefore the image has a high quality but on the other hand, fog is liable to occur. For this reason, by providing a potential difference between the DC voltage applied to the developing sleeve 24 and the charge potential of the photosensitive drum 101 (i.e., a white background portion potential), the fog is prevented.

A trimming member (chain cutting) (regulating blade) 25 is constituted by a non-magnetic member formed with an aluminum plate or the like extending in the longitudinal axial direction of the developing sleeve 24. The trimming member 25 is disposed upstream of the photosensitive drum 1 with respect to the developing sleeve rotational direction. Both the toner and the carrier of the developer pass through the gap between an end of the trimming member 25 and the developing sleeve 24 and are sent into the developing region A.

Incidentally, by adjusting the gap between the trimming member 25 and the developing sleeve 24, the trimming amount of the magnetic brush chain of the developer carried on the developing sleeve 24 is regulated, so that the amount of the developer sent into the developing region A is adjusted. In this embodiment, a coating amount per unit area of the developer on the developing sleeve 24 is regulated at 30 mg/cm$^2$ by the trimming member 25. The gap between the trimming member 25 and the developing sleeve 24 is set at a value in the range of 200-1000 μm, preferably, 300-700 μm. In this embodiment, the gap is set at 500 μm.

Further, in the developing region A, the developing sleeve 24 of the developing device 104 moves in the same direction as the movement direction of the photosensitive drum 101 at a peripheral speed ratio such that the developing sleeve 24 moves at the peripheral speed which is 1.75 times that of the photosensitive drum 101. With respect to the peripheral speed ratio, any value may be set as long as the set value is in the range of 1.3-2.0, preferably, 0.5-2.0. The greater the peripheral (moving) speed ratio, the higher the development efficiency. However, when the ratio is excessively large, problems such as toner scattering and developer deterioration occur. Therefore, the ratio is desired to be set in the above-mentioned range.

Further, at the opening (communicating portion) 26 in the developing container 20, as the temperature detecting means for the developer, the temperature sensor 104T is disposed. The temperature sensor 104T is disposed in the developer in the developing device 4, and directly detects the temperature of developer. The disposition place of the temperature sensor 104T in the developing container 20 may desirably be a position in which a sensor surface is buried in the developer in order to improve detection accuracy. However, as regards the disposition place of the temperature sensor 104T, it is not limited thereto. Although accuracy somewhat lowers, a constitution in which the temperature in the developing device is detected using a temperature sensor provided in an image forming apparatus main assembly may also be employed.

Here, the temperature sensor 104T will be described more specifically with reference to FIG. 6. In this embodiment, as the temperature sensor 104T, a temperature/humidity sensor ("SHT1X series", mfd. by Sensirion Co., Ltd.) was used. The temperature sensor 104T includes a sensing element 1001 of an electrostatic capacity polymer as a humidity detecting device and includes a band gap temperature sensor 1002 as a temperature detecting device. The temperature sensor 104T is a CMOS device having such a specification that outputs of the sensing element 1001 and band gap temperature sensor 1002 are coupled by a 14 bit-A/D converter 1003 and serial output is performed through a digital interface 1004.

The band gap temperature sensor as the temperature detecting device uses a thermistor linearly changed in resistance value with respect to the temperature and calculates the temperature from the resistance value. Further, the sensing element 1001 as the humidity detecting device is a capacitor in which a polymer is inserted as a dielectric member. The sensing element 1001 detects the humidity by converting the electrostatic capacity into the humidity by utilizing such a property that the content of water which is adsorbed by the polymer is changed depending on the humidity and as a result, the electrostatic capacity of the capacitor linearly changes with respect to the humidity. The temperature sensor 104T used in this embodiment can detect both of the temperature and the humidity. However, actually, only a detection result of the temperature is utilized, so that the use of other sensors capable of detecting only the temperature may also be sufficient.

[Supply of Developer]

A supplying method of the developer in this embodiment will be described with reference to FIGS. 4 and 5. At an upper portion of the developing device 104, a toner supplying device 30 as a supplying means for supplying the toner to the developing device 104 depending on a consumption amount of the developer is provided. The toner supplying device 30 includes a hopper 31 accommodating a two-component developer for supply in which the toner and a carrier are mixed. The hopper 31 includes a screw-shaped supplying member, i.e., a supplying screw 32 at a lower portion thereof, and an end of the supplying screw 32 extends to a position of a developer supplying opening 30A provided at a rear end portion of the developing device 104.

The toner in an amount corresponding to an amount of the toner consumed by the image formation is passed from the hopper 31 through the developer supplying opening 30A and is supplied into the developing device 104 by a rotational force of the supplying screw 32 and the force of gravitation of the developer. The amount of the developer for supply to be supplied from the hopper 31 into the developing device 104 is roughly determined by the number of rotations (rotational frequency) of the supplying screw 32. This number of rotations is determined by a CPU 206 (FIG. 3) as a control means on the basis of a video count value of the image data and a detection result of a (toner) content (density) sensor 11 shown in FIG. 2. The central sensor 11 detects the content of a patch image (reference toner image) obtained by developing a reference latent image formed on the photosensitive drum 101.

Here, the two component developer, which comprises the toner and the carrier, stored in the developing container 20 will be described more specifically. The toner contains primarily binder resin, and coloring agent. If necessary, particles of coloring resin, inclusive of other additives, and coloring particles having external additive such as fine particles of choroidal silica, are externally added to the toner. The toner is negatively chargeable polyester-based resin and is desired to be not less than 4 μm and not more than 10 μm, preferably not more than 8 μm, in volume-average particle size.

As for the material for the carrier, particles of metal, the surface of which has been oxidized or has not been oxidized, iron, nickel, cobalt, manganese, chrome, rare-earth metals, alloys of these metals, and oxide ferrite are preferably usable. The method of producing these magnetic particles is not particularly limited. A weight-average particle size of the carrier may be in the range of 20-60 μm, preferably, 30-50 μm. The carrier may be not less than $10^7$ ohm·cm, preferably, not less than $10^8$ ohm·cm, in resistivity. In this embodiment, the carrier with a resistivity of $10^8$ ohm·cm was used.

Incidentally, the volume-average particle size of the toner used in this embodiment was measured by using the following device and method. As the measuring device, a sheath-flow electric resistance type particle size distribution measuring device ("SD-2000", manufactured by Sysmex Corp.) was used. The measuring method was as follows. To 100-150 ml of an electrolytic solution which is a 1%-aqueous NaCl solution prepared using reagent-grade sodium chloride, 0.1 ml of a surfactant as a dispersant, preferably, alkylbenzenesulfonic acid salt, was added, and to this mixture, 0.5-50 mg of a measurement sample was added. The electrolytic solution in which the sample was suspended was dispersed for about 1-3 minutes in an ultrasonic dispersing device. Then, the particle size distribution of the sample, the size of which is in the range of 2-40 μm was measured with the use of the above-mentioned measuring device ("SD-2000") fitted with a 100 μm aperture, and the volume-average distribution was obtained. Then, a volume-average particle size was obtained from the thus-obtained volume-average distribution.

Further, the resistivity of the carrier used in this embodiment was measured by using a sandwich type cell with a measurement electrode area of 4 $cm^2$ and a gap between two electrodes of 0.4 cm. A voltage E (V/cm) was applied between the two electrodes while applying 1 kg of weight (load) to one of the electrodes, to obtain the resistivity of the carrier from the amount of the current which flowed through the circuit.

[Forced Consumption Mode]

Next, (an operation in) a forced consumption mode in this embodiment will be described with reference to FIGS. 7-13. First, in this embodiment, in the case where a condition described later is satisfied, such as in the case where an image having a low image ratio (print ratio) is continuously formed, the operation in the forced consumption mode in which the toner is forcedly consumed is executable after the image formation is interrupted or during post-rotation with an end of an image forming job. That is, in the case where a low-duty image is continued, the proportion of the toner transferred from the inside of the developing container 20 onto the photosensitive drum 101 becomes small. For this reason, the toner in the developing container 20 is subjected to stirring of the first and second feeding screws 22*a* and 22*b* and rubbing at the time of passing through the trimming member 25, for a long time. As a result, the above-described external additive for the toner comes off the toner or is buried in the toner surface, so that the flowability or charging property of the toner in lowered and thus the image quality is deteriorated. Here, the important point is that the toner deterioration is proportional to a time in which the toner continuously stays in the developing device, and shortening of this stay time leads to toner deterioration suppression. Therefore, in general, the operation in the forced consumption mode in which after the image formation is interrupted (downtime is provided) or during the post-rotation, the deteriorated toner in the developing device 104 is used for the development in a non-image region and is forcedly discharged (consumed).

On this occasion, attention is focused on a difference in progress of the toner deterioration depending on the print ratio, and a downtime by a toner discharging operation and a toner discharging frequency are changed depending on the print ratio. Incidentally, the print ratio is an area of the toner (image) formed in a maximum image forming region, and for example, a solid black image is 100%, and a solid white image is 0%.

Figure 7:
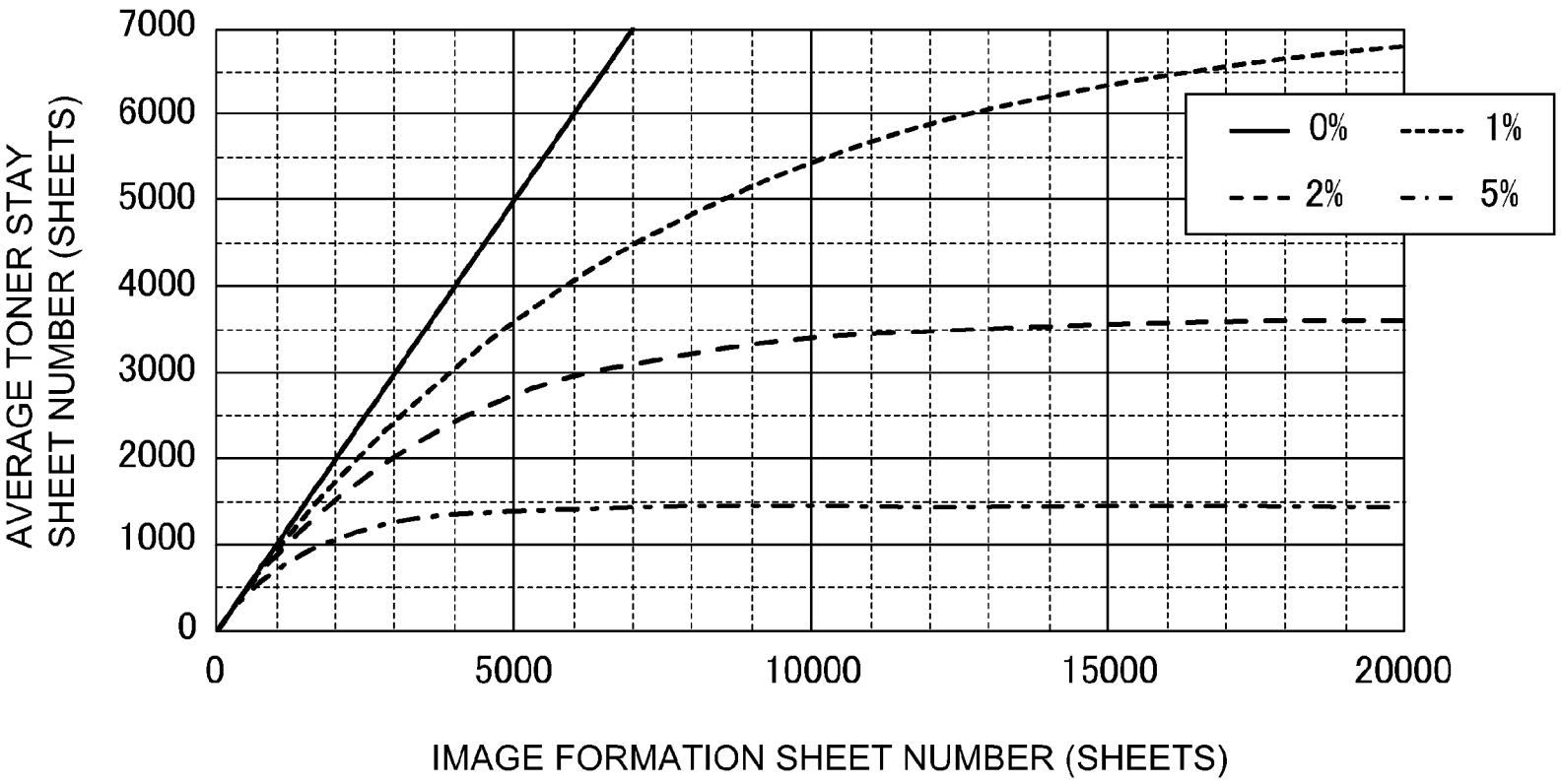
FIG. 7 is a diagram showing an average toner stay sheet number relative to an image formation sheet number at respective print ratios.

Next, in the case where images with different print ratios are formed on a plurality of sheets, how the stay time of the toner in the developing device changes and how the toner deterioration progresses will be described using FIG. 7. FIG. 7 shows a relation between an average toner stay sheet number in the developing device and an image formation sheet number in the case where image formation of a plurality of sheets with the images different in print ratio is carried out. The average toner stay sheet number shows the number of sheets on which the toner (image) stays in the developing device on average on a sheet number basis.

In FIG. 7, a solid line shows the average toner stay sheet number in the case where the image formation with the print ratio of 0% is made. At the print ratio of 0%, the toner is not consumed, and therefore all of the toner (particles) in the developing device stayed in the developing device in an amount corresponding to one sheet every increment of one sheet in terms of the image formation sheet number. In FIG. 7, a small dotted (broken) line shows the average toner stay sheet number in the case where the image formation with the print ratio of 1% is made. Compared with the case of the print ratio of 0%, toner consumption is made correspondingly to the print ratio of 1%, and therefore the toner in an amount corresponding to the print ratio of 1% is replaced as a supply toner, i.e., a new (fresh) toner. As a result, the average toner stay sheet number somewhat increases from one sheet by less than one sheet with an increment of one sheet in durability sheet number (image formation sheet number) in an amount corresponding to the replacement with the new toner, so that the average toner stay sheet number has a tendency to saturate when the image formation sheet number increases.

In FIG. 7, the other dotted (broken) line shows the average toner stay sheet number in the case where the image formation with the print ratio of 2% is made. It is understood that the replacement with the new toner is made correspondingly to the print ratio of 2%, i.e., 2 times the amount in the case of the print ratio of 1%, and therefore, an increase rate of the average toner stay sheet number further decreases, so that it is understood that a saturated average toner stay sheet number becomes low. Further, similarly, in the case where the image formation with the print ratio of 5% is made, as shown by chain line, it is understood that the increase rate further lowers and that the saturated average toner stay sheet number further becomes low. A saturated value of the average toner stay sheet number is in an inversely proportional relation with the average print ratio, so that in a condition in this embodiment, the saturated value is about 7200 sheets for the print ratio of 1%, about 3600 sheets for the print ratio of 2%, and about 1450 sheets for the print ratio of 5%.

Next, a proportional relation between the above-described average toner stay sheet number and the toner detection will be described. As described above, when the toner is subjected to long-term stirring and slide deterioration in the developing device, peeling-off and burying of an external additive contained in the toner particles generate, so that a change in flowability and charging property of the toner generates. Such a change in state of the external additive can be quantitatively grasped using a BET value. In this embodiment, BET value measurement of the toner was made using QUADRASORB SI manufactured by Quantachrome Instruments Japan G. K. The BET value of the toner used as a change in state of deposition of the external additive on the toner surface shows a deposition amount of the external additive on the toner surface, and with a decrease in amount of the external additive existing on the toner surface, the toner BET value becomes small. That is, the external additive large in BET value is externally added to the surface of a toner base material, whereby also the BET value as that of the toner becomes large, but the toner BET value becomes small due to the burying of the external additive in the toner resin material and liberation of the external additive from the toner surface. In the case where there is no external additive on the toner surface, the BET value of the toner is equal to the BET value of the toner base material.

Figure 8:
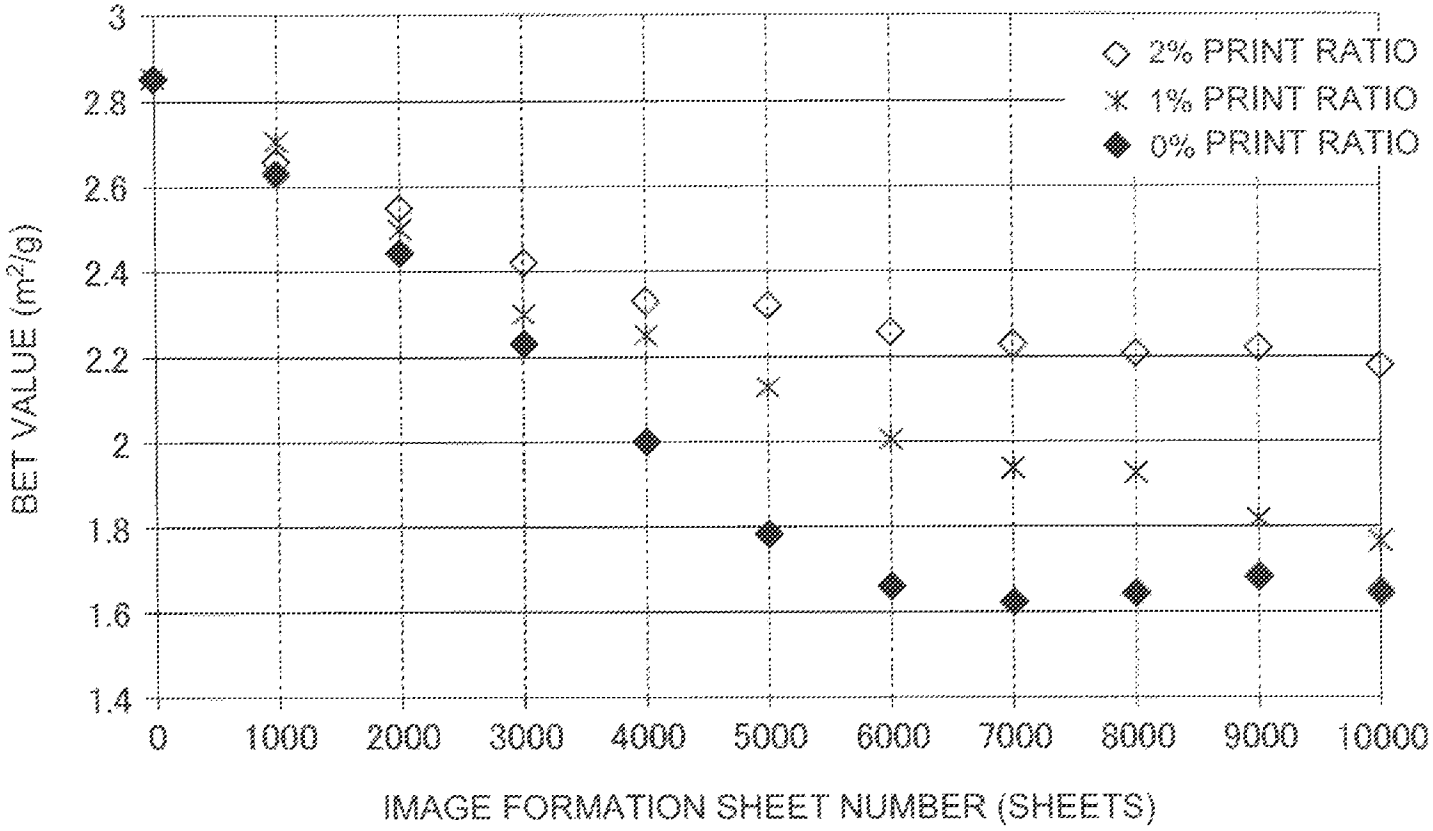
FIG. 8 is a diagram showing a BET value relative to the image formation sheet number at respective print ratios.
Figure 9:
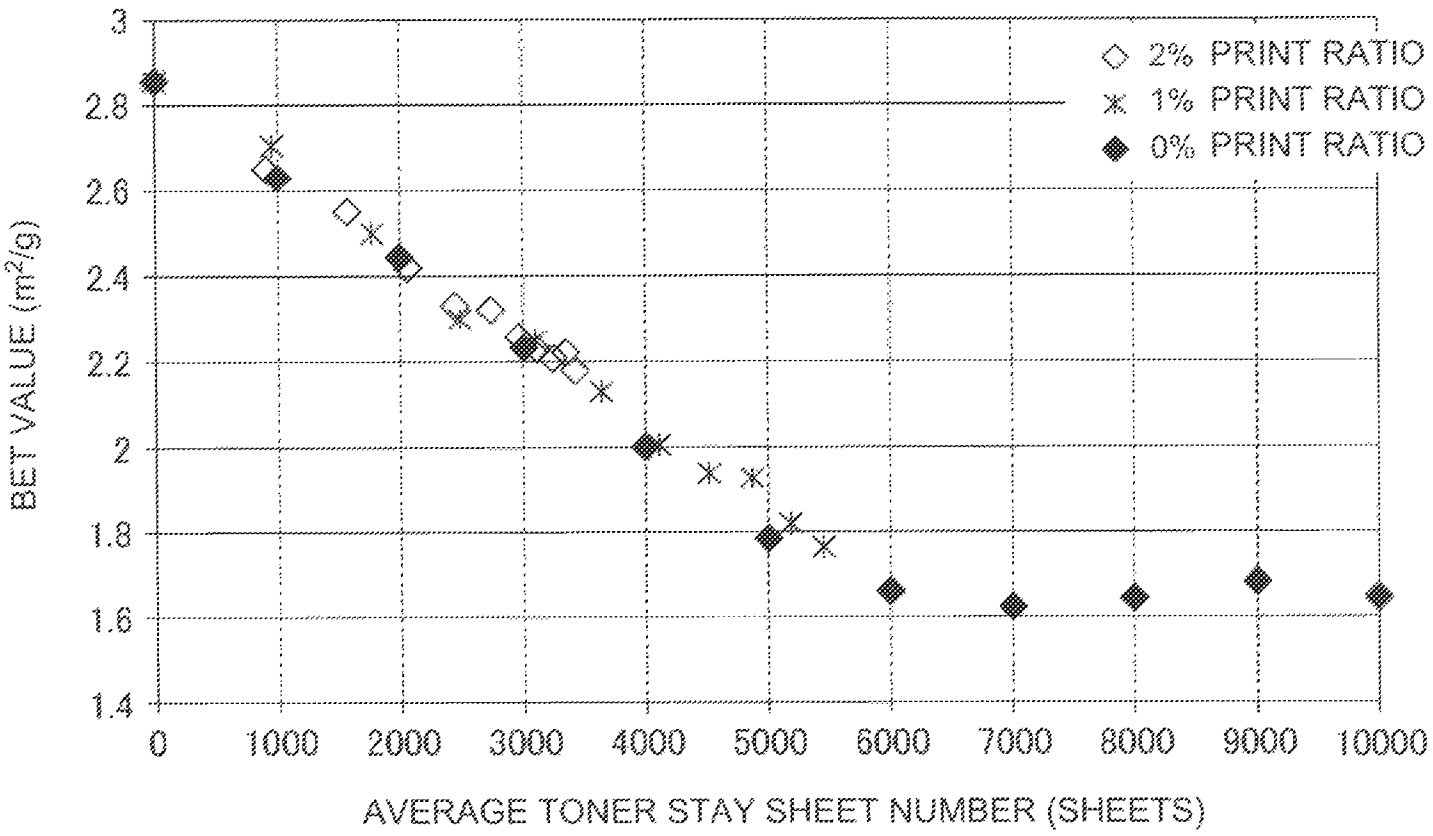
FIG. 9 is a diagram showing the BET value relative to the average toner stay sheet number at the respective print ratios.

Next, the developer is sampled with a 1000 sheet-interval when the image formation is effected with the print ratios of 0%, 1% and 2% in a 30° C.-environmental condition, and a relation between the BET value as an index of the toner deterioration and the image formation sheet number and a relation between the BET value and the average toner stay sheet number were checked. Results thereof are shown in FIG. 8 and FIG. 9. First, from FIG. 8, a state in which the BET value decreases with the image formation can be grasped, and it is understood that a change in BET value with the image formation is larger when a lower print ratio image is formed. Incidentally, leveling-off of the BET value in the neighborhood of 1.6 $m^2/g$ suggests that there is almost no toner and the BET value becomes a value corresponding to the above-described BET value of the toner base material. FIG. 9 is a graph in the case where the abscissa of FIG. 9 is converted into the average toner stay sheet number. From FIG. 9, it is understood that the average toner stay sheet number and the BET value are correlated with each other irrespective of the image print ratios 0%, 1% and 2%, i.e., that the toner detection (BET value in this embodiment) can be grasped uniquely by the average toner stay sheet number.

Incidentally, in this embodiment, when the BET value as the toner deterioration is 2.0 $m^2/g$ or less, toner scattering, fog and granularity appear conspicuously. That is, as shown in FIG. 9, it is understood that the average toner stay sheet number of 4000 sheets when the BET value is 2.0 $m^2/g$ is a threshold at which the above-described problem generates. For example, when the print ratio is 2%, a saturated sheet number of the average toner stay sheet number is 3600 sheets, and therefore even when the long-term image formation is effected with the same print ratio image, the above-described problem is not generated. On the other hand, in the case of the print ratio of 1%, the image defect generates in the neighborhood of the image formation sheet number exceeding 6000 sheets. That is, in this embodiment, it is understood that if the image is 2% or more in print ratio, even when the toner is deteriorated by the image formation, the toner does not reach such a level the fog and the granularity are conspicuous. As described above, in the case where the image formation with the low print ratio is effected, the toner stays in the developing device for a long term and thereby the toner deterioration generates, and therefore, it is understood that toner discharge control may only be required to be executed so that the average toner stay sheet number is not less than a predetermined sheet number.

Here, the important point is that the average toner stay sheet number proportional to the toner deterioration excessively requires the image formation of several thousand sheets 10000 sheets even when the low print ratio images are continuously formed although the average toner stay sheet number depends on the image print ratio. Specifically, in the case where the image formation with the print ratio of 1% is effected, an image formation sheet number requires about 6000 sheets until the average toner stay sheet number reaches 4000 sheets. Conversely, even when the image formation with the 1% print ratio image is effected, the image defect does not generate until the image formation sheet number reaches 6000 sheets.

In the case of conventional forced toner discharge control as described in Japanese Laid-Open Patent Application 2006-23327, this point has been taken into consideration. When the control is effected in accordance with the control described in Japanese Laid-Open Patent Application 2006-23327, even in the case where the image formation with the same print ratio is effected to the end of a lifetime, the forced toner discharge is executed using, as a reference developer amount, a value at which a degree of toner deterioration does not exceed an assumed level. That is, in the case where the image formation with the print ratio of less than 2% in accordance with the control described in Japanese Laid-Open Patent Application 2006-23327, the forced toner discharge is executed irrespective of the average toner stay sheet number, and therefore the toner was consumed in an amount which is not less than a necessary amount in some cases. Therefore, in this embodiment, as described below, forced toner discharge control (forced consumption mode) is executed.

In the case of this embodiment, the CPU 206 as the control means is capable of executing the operation in the forced consumption mode in which the toner is forcedly consumed by the developing device. For this purpose, the CPU 206 functions as a difference calculating means, an integrating means and an executing means. The difference calculating means calculates a difference (Vt−V) between a consumption amount (video count value V) depending on the amount of the toner consumed every predetermined unit of image formation and a reference value (toner deterioration threshold video count Vt) set with respect to this predetermined unit. The integrating means acquires an integrated value (toner deterioration integrated value X) by integrating the above-described difference (Vt−V) calculated by the difference calculating means. Further, the executing means executes the operation in the forced consumption mode in the case where this integrated value is larger than a predetermined threshold (execution threshold A).

Here, setting of a toner deterioration threshold as a reference value which is used for executing the operation in the forced consumption mode and which is set with respect to the predetermined unit of image formation will be described. Incidentally, the predetermined unit of image formation is a unit, set for effecting the image formation, such as a single A4-sized recording material. The predetermined unit is not limited in size and sheet number thereto, but may also be any size such as A3 or B5, and may also be appropriately set depending on the size or status of use, such as ½ sheet or plural sheets, principally used in the image forming apparatus. In this embodiment, one sheet of the A4-sized recording material is used as the predetermined unit (of image formation).

As described above, in the case where the proportion of the toner transferred onto the photosensitive drum is small and the amount of the toner supply into the developing container 20 is small, i.e., in the case where the print ratio is low, the toner deterioration has gone. As a value (the reference value described above) indicating that a lowering in image quality due to the toner deterioration generates when the print ratio is low to what extent, in this embodiment, the "toner deterioration threshold video count Vt" is set.

In the case of this embodiment, on the basis of information on an average toner consumption amount per predetermined sheet number or per predetermined driving time of the developing device (information on an average movement amount of the toner consumed per predetermined sheet number (5000 sheets in this embodiment as described later)), the above-described reference value is set at a plurality of levels. In the case of this embodiment, the information of this average toner consumption amount is an average print ratio (average image ratio) calculated by averaging video count values used for respective image forming operations correspondingly to the predetermined sheet number (5000 sheets in this embodiment), and in the following, this is referred to as a long term average print ratio. The CPU 206 sets the above-described reference value at a first reference value in the case where this long term average print ratio is less than a value corresponding to a predetermined reference toner consumption amount and sets the above-described reference value at a second reference value lower than the first reference value in the case where the long term average print ratio is not less than the value corresponding to the predetermined reference toner consumption amount. This value corresponding to the predetermined reference toner consumption amount is a print ratio (image ratio) in this embodiment and is a value such that the degree of toner deterioration falls within an assumed level (level at which there is no influence on an output image) even when the image formation with the same print ratio is effected to the end of a lifetime of the developing device. In this embodiment, the value corresponding to the predetermined reference toner consumption amount was set at the print ratio of 2%. That is, as described above, if the image has the print ratio of not less than 2%, even when the toner is deteriorated by the image formation, the toner does not reach a level that the fog and the granularity thereof are conspicuous, and therefore the value corresponding to the predetermined reference toner consumption amount was set at 2% in print ratio.

Incidentally, in this embodiment, as the long term average print ratio, the video count value per printing of one sheet is used for calculation thereof, but the following can be used in place of the video count value. For example, an average toner consumption amount per predetermined rotation time of the developing sleeve (per predetermined driving time of the developing device), not per printing of one sheet. This toner consumption amount is calculated similarly from the video count value. That is, if the number of rotations (rotational frequency) per printing of one sheet of the developing sleeve is the same, by using such a definition, there is no particular change in control. On the other hand, in the case where interrupt control or the like with rotation of the developing sleeve is effected between printing operations, or in the like case, the toner deterioration with rotation of the developing sleeve generates correspondingly thereto, and therefore it is preferable that the above-described value is controlled as the consumption amount per developing sleeve rotation time.

Further, in this embodiment, the toner consumption amount is calculated by the video count, but for example, a supply toner amount is controlled and detected, and may also be used as the toner consumption amount. As a supply toner amount detecting means, the number of rotations or the like of a known supplying screw is used, so that the toner consumption amount can be calculated.

Here, a feature of the control of the operation in the forced consumption mode in this embodiment is in that the reference value (toner deterioration threshold video count Vt) is changed depending on the long term average print ratio, not a fixed value. As described above, the degree of toner deterioration progresses in proportion to the average toner stay sheet number, and further, the saturated value of the average toner stay sheet number is in a reversely proportional relation with the print ratio as shown in FIG. 7. Here, the important point is that since the average toner stay sheet number tends to be saturated by the image formation sheet number (long-term sheet number) of about several thousand sheets, the average toner stay sheet number is correlated with an average print ratio value over the long-term sheet number to some extent.

Accordingly, in this embodiment, the degree of toner deterioration proportional to the average toner stay sheet number is predicted using the long term average print ratio which is an average of print ratios of 5000 sheets, and the toner deterioration threshold video count value is changed correspondingly to the degree of toner deterioration. Further specifically, the saturated value of the average toner stay sheet number is a value obtained by dividing a predetermined total toner amount in the developer amount in the developing device by a toner amount corresponding to the predetermined print ratio of 2% which is the predetermined reference toner consumption amount. In this embodiment, the total toner amount is 32 g which is 8% of 400 g of the developer, and the toner amount corresponding to the print ratio of 2% is 0.0088 g. For this reason, the saturated sheet number of the average toner stay sheet number is about 3600 sheets.

As shown in FIG. 7, the image formation sheet number (about 11000 sheets) required for saturation of the average toner stay sheet number at the predetermined print ratio of 2% is larger than the saturated value (3600 sheets) of the average toner stay sheet number (is about 3 times the saturated value). For this reason, the predetermined sheet number at the long term average print ratio may preferably be set at a value higher than the saturated value of the average toner stay sheet number. That is, the predetermined sheet number may preferably be set at a larger value than the saturated sheet number of 3600 sheets. Here, in the case where the sheet number at the long term average print ratio is made smaller than the saturated sheet number of 3600 sheets of the average toner stay sheet number, the sheet number is excessively small as the sheet number for predicting (estimating) the degree of toner deterioration, so that there is a possibility that the operation in the forced consumption mode is executed more than necessary. That is, as described above, the average toner stay sheet number tends to be saturated by the image formation sheet number (long-term sheet number) of about several thousand sheets, and therefore is correlated with the average print ratio value over the long-term sheet number to some extent. For this reason, in the case where the long term average print ratio is calculated by the sheet number before the average toner stay sheet number is saturated, there is a possibility that the correlation of the average toner stay sheet number with the long term average print ratio (average print ratio value) is not established. That is, there is a possibility that prediction of the degree of toner deterioration cannot be made properly.

On the other hand, the predetermined sheet number at the long term average print ratio is made excessively large, there is a possibility that even when a "state in which DUTY is low and the image formation sheet number is large" such that the reference value (toner deterioration threshold video count Vt) which has to be originally changed is formed, this reference value is not changed. For example, in the case where the image formation is effected with the print ratio of 1%, as described above, the image defect generates at about 6000 sheets. For this reason, in this embodiment, the predetermined sheet number at the long term average print ratio is less than 6000 sheets. In summary, the predetermined sheet number at the long term average print ratio may preferably be set at not less than 3600 sheets and less than 6000 sheets. In this embodiment, the predetermined sheet number is set at 5000 sheets.

Here, a calculating method of the long term average print ratio will be described using FIG. 11. In this embodiment, as shown in (a) of FIG. 11, a video count value per image formation of one sheet is stored for 5000 sheets as V1 to V5000. That is, information on an average movement value of the amount of the toner consumed every predetermined sheet number (5000 sheets in this embodiment). Then, integrated values of the video count values for 5000 sheets are averaged, so that the long term average print ratio is calculated from the print ratio of 100%=video count 512. Further, during subsequent image formation, the video count value V1 for first sheet is deleted, and video counts for 5000 sheets including video count values up to a video count value 5001 for the 5001-th sheet are stored and averaged, so that the long term average print ratio is calculated.

Incidentally, in this case, there is a need to store the video count values corresponding to 5000 sheets, and therefore a memory capacity for 5000 pieces is needed. For this reason, as shown in (b) of FIG. 11, video count values per 100 sheets are integrated, averaged and stored, and thus the video count values for 100 sheets may also be calculated altogether in an approximation manner. In the present invention, also the thus-calculated long term average print ratio is the information on the average movement value of the amount of the toner consumed every predetermined sheet number (5000 sheets in this embodiment). That is, video count values from the first sheet to the 100-th sheet are sequentially integrated and are stored as an integrated video count value 1, and also video count values from the 101-th sheet to the 200-th sheet are similarly sequentially integrated and are stored as an integrated video count value V2. The video count values V1 to V50 corresponding to 100 sheets×50 blocks are stored, and each of the video count values V1 to V50 is integrated are averaged, so that an average video count is calculated and the long term average print ratio can be acquired with 100-sheet intervals. During subsequent image formation of 100 sheets, video count values for from the 5001-th sheet to the 5100-th sheet are sequentially integrated and stored as an integrated video count V51 while deleting V1, so that the long term average print ratio can be acquired from V2 to V51. As regards the progress of the degree of toner deterioration, in a general developer capacity and an amount of the toner used, a change amount is slight within the image formation sheet number of 100 sheets. For this reason, even when the calculation is made with the 100-sheet intervals, a degree of the influence is small, and therefore, in the case where the calculation is made with a small memory capacity, the above-described methods are appropriately selectable.

Figure 11:
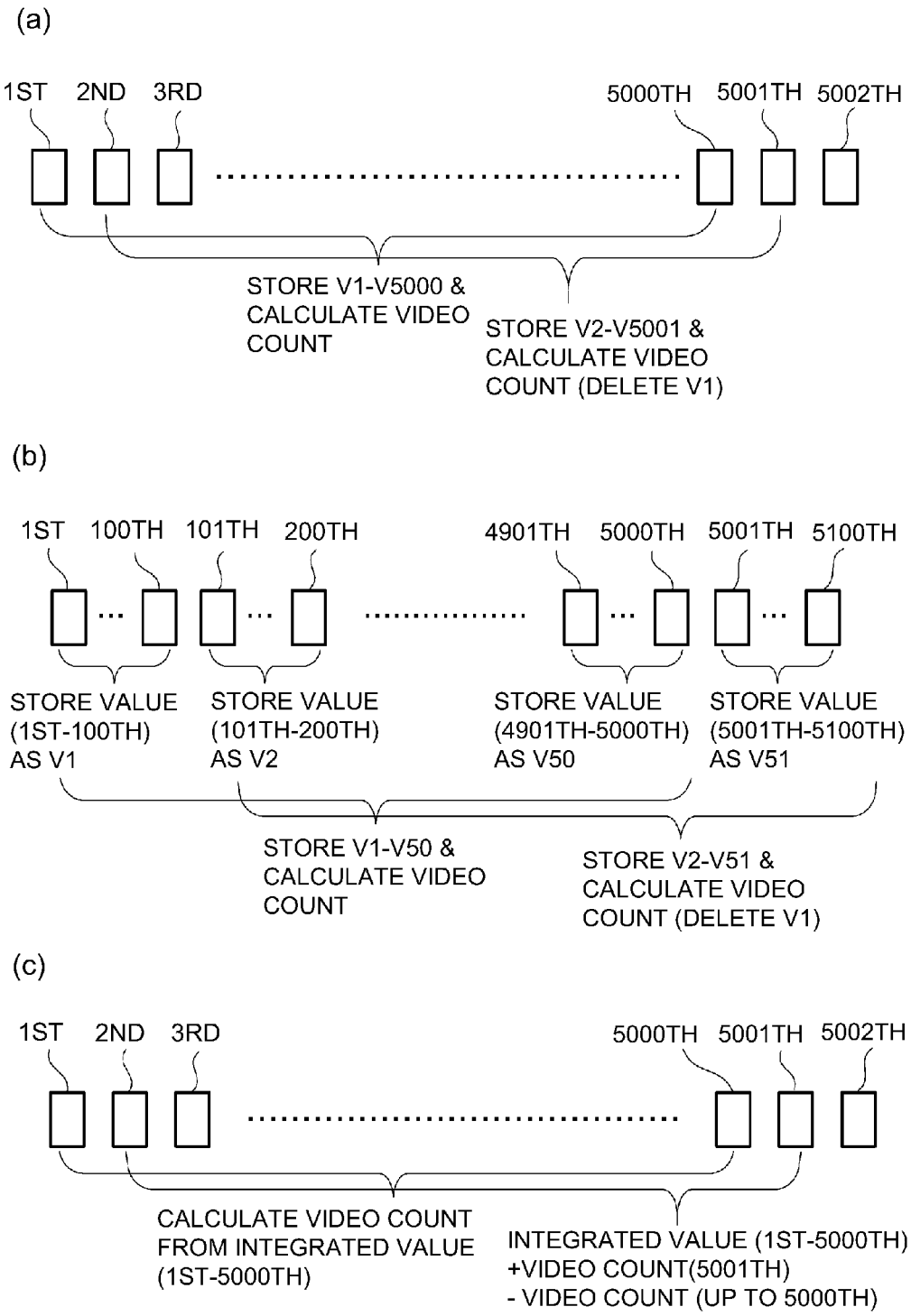
FIG. 11 includes schematic views showing three examples of a calculating method of a long term average print ratio according to the First Embodiment.

Further simply, as shown in (c) of FIG. 11, video count values from the first sheet to the 5000-th sheet are sequentially integrated and averaged, so that the average video count value is calculated and the long term average print ratio is calculated. During subsequent image formation, the video count value for the 5001-th sheet is added to the integrated video count value for the first to 5000-th sheets, and then the average video count value for up to 5000-th sheet is subjected from a resultant video count value, and the thus-calculated value is averaged, so that an average video count value and the long term average print ratio is calculated. In the present invention, also the thus-calculated long term average print ratio is the information on the average movement value of the amount of the toner consumed every predetermined sheet number (5000 sheets in this embodiment).

Figure 10:
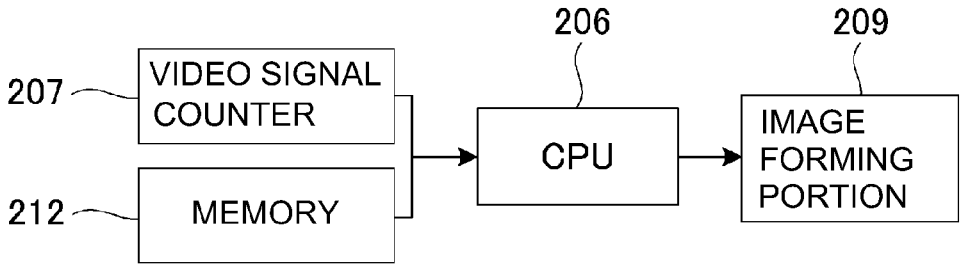
FIG. 10 is a control block diagram of an operation in a forced consumption mode according to the First Embodiment.

In this embodiment, in order to effect the control as described above, as shown in FIG. 10, the video signal counting portion 207, the memory 212, the CPU 206 and the image forming portion 209 are provided. A control block diagram of FIG. 10 is simplified by extracting a part of the control block diagram of FIG. 3. The video signal counting portion 207 acquires the video count value as described above, The CPU 206 effects various calculations as described above, such as integration or the like of the video count value acquired by the video signal counting portion 207. In the memory 212, the video count value acquired by the video signal counting portion 207 and a calculation result of the CPU 206 and the like are stored. Further, the CPU 206 discriminates propriety of execution of the operation in the forced consumption mode from the video count value acquired by the video signal counting portion 207 and the information stored in the memory 212 in accordance with a flow of FIG. 12 described below. Then, the CPU 206 causes the image forming portion 209 to execute the operation in the forced consumption mode in accordance with a flow of FIG. 13 described later. The image formation portion 209 drive controls respective constituent elements of the above-described respective image forming stations.

[Discrimination of Propriety of Execution of Operation in Forced Consumption Mode]

Next, details of discrimination of propriety of execution of the operation in the forced consumption mode will be described with reference to FIG. 12. As a precondition, a concept of the operation in the forced consumption mode for each of the colors is the same. Therefore, the colors are omitted from description in the following flowcharts and the like in some cases, but in those cases, common control is effected for each of the colors. In this embodiment, as an easy-to-understand example, the case where such an image that the print ratios per (one) sheet for the colors of Y, M, C and K are 5% for Y, 5% for M, 5% for C and 1.5% for K (hereinafter, this image is referred to as a "low-duty-black image chart") is continuously formed on A4-sized sheets is considered.

First, when the image formation is started, the video signal count portion 207 shown in FIGS. 3 and 10 calculates video count values V(K), V(M), V(C) and V(K) for the respective colors, every printing of one sheet. That is, the above-described consumption amount is calculated (step S1). In this embodiment, the video count (value) of the whole (entire) surface solid image (the image with the print ratio of 100%) on one surface (side) of A4-sized sheet for a certain color is 512. The video counts of the "low-duty-black image chart" are V(Y)=26, V(M)=26, V(C)=26 and V(K)=8. Here, when each video count is calculated, the fractional portion of the number is rounded off to the nearest integer.

Next, setting of the toner deterioration threshold video count Vt (reference value) is made. The toner deterioration threshold video count Vt referred to herein means a video count value corresponding to a necessary minimum toner consumption amount in order to prevent generation of deterioration of an image quality due to the toner deterioration. In this embodiment, as described above, the toner deterioration threshold video count Vt is changed depending on the long term average print ratio (information on the average toner consumption amount). Specifically, the video count values used for the respective image forming operations are averaged correspondingly to 5000 sheets, so that the long term average print ratio is calculated (S2).

Then, whether or not this long term average print ratio is less than a predetermined print ratio of 2% (long term average print ratio<2%) is discriminated. In the case where the long term average print ratio is less than the predetermined print ratio of 2% (Y of S3), the toner deterioration threshold video count Vt is set at 10 (corresponding to the print ratio of 2%, first reference value) (S4). On the other hand, in the case where the long term average print ratio is not less than the predetermined print ratio of 2% (N of S3), as a value of the print ratio of less than at least 2%, the toner deterioration threshold video count Vt is set at 5 (corresponding to the print ratio of 1%, second reference value) (S5).

Incidentally, in a developing device at an initial stage such as immediately after exchange (in initial developer), there is no average print ratio, and therefore as the degree of toner deterioration, the average print ratio is treated as 100% which is substantially equal to that at the initial stage and then the calculation is made. Here, the average toner stay sheet number in the case where images with the print ratio of 100% are formed on 5000 sheets is about 70 sheets, and as shown in FIG. 9, the BET value which is an index of the toner deterioration this time is substantially the same as that of the initial developer, and therefore can be used approximately. That is, in this embodiment, the CPU 206 uses 5 (second reference value) as the toner deterioration threshold video count Vt irrespective of the long term average print ratio until the image formation sheet number from the initial state of the developing device to the predetermined sheet number (5000 sheets). Incidentally, in the case where the long term average print ratio (average movement value) is calculated by the driving time of the developing device, in a period until the driving time from the initial state of the developing device reaches a predetermined driving time (time corresponding to 5000 sheets), irrespective of the long term average print ratio, 5 is used as the toner deterioration threshold video count.

Next, a difference Vt−V between the video count value V calculated in S1 and the toner deterioration threshold video count Vt set in S3-S5 is calculated (S6). Then, a sign (positive/negative) of the difference Vt−V is discriminated (S7). That is, the difference is calculated by subtracting the video count value V which is a consumed value from the toner deterioration threshold video count Vt which is a reference value. Then, whether or not the difference is Vt−V>0 is discriminated, and in the case where the difference is a positive value (Vt−V)>0, Y of S7), the print ratio is low and thus a state in which the toner deterioration progresses is formed, and therefore the difference is integrated and the integrated value, i.e., the toner deterioration integrated value X is acquired. In other words, the difference Vt−V is added to the toner deterioration integrated value X (S8). On the other hand, when the difference is the negative value (Vt−V<0) and the difference is 0 (N of S7), the print ratio is high and a state in which the toner deterioration does not progress is formed, and therefore 0 is added to the toner deterioration threshold video count X (S9). In other words, when the difference is the negative value, 0 is added to the toner deterioration threshold video count X, and when the difference is a value other than the negative value, the difference is added to the toner deterioration threshold video count X. Here, the toner deterioration threshold video count X is an index indicating a current toner deterioration state, and is an integrated value of the video count value calculated by Vt−V.

Incidentally, in the case where the print ratio is high, i.e., in the case where the difference is the negative value, 0 is added to the toner deterioration threshold video count X. However, in the case where the image high in print ratio is printed, the toner deterioration state is restored by the toner replacement, and therefore, a constitution in which a negative value is added in consideration of a value corresponding to the restoration may also be employed. In this case, in simple calculation, the toner deterioration integrated value X is 0 or less in some cases, but in the case where the toner deterioration integrated value is 0 or less, the toner deterioration integrated value may preferably be set at 0. This is because even when the image printing with the high print ratio is continued and the toner replacement becomes frequent, the deterioration is not restored more than in the initial state.

Next, by S8 or S9, with respect to the toner deterioration integrated value X calculated and renewed every image formation, a difference (A−X) from a discharge execution threshold A (predetermined threshold) is calculated (S10). Here, the discharge execution threshold A is a predetermined threshold value which is arbitrarily settable. The smaller the discharge execution threshold A, the higher the frequency of execution of the toner discharging operation (operation in forced consumption mode) even in the continuous image formation at the same print ratio (the amount of the toner consumed per unit driving time of the developing device in the operation in the forced consumption mode). The discharge execution threshold A is set at 512 in this embodiment. When the set value of the discharge execution threshold A is excessively large, a time in which the toner deterioration progresses until the toner discharging operation is performed is long, so that it is desirable that the set value is approximately equal to the video count value of the whole surface solid image (the image with the print ratio of 100%) on one surface of A4-sized sheet to A3-sized sheet. Further, e.g., with a larger volume of the developer which can be retained in the developing container 20, there is a tendency that the toner discharge execution threshold A can be set at a larger value.

Further, the sign (positive or negative) of the difference (A−X), calculated by S10, between the toner deterioration integrated value X and the discharge execution value A (Step S11). That is, whether or not the difference (A−X) is 0 or more (A−X≥0). Then, in the case (A−X) is 0 or more (A−X≥0, Y of S11), discrimination that the toner deterioration does not progress to the extent that the operation in the forced consumption mode is required to be executed immediately is made, and subsequently the image formation is executed S12). On the other hand, in the case where the difference (A−X) is negative, i.e., in the case where the toner deterioration integrated value X is larger than the discharge execution value A (N of S11), the toner deterioration sufficiently progresses and therefore discrimination that there is a need to execute the toner discharging operation immediately is made. Then, the image formation is interrupted and the toner discharging operation is executed (S13). After the toner discharging operation is executed, the toner deterioration integrated value X is reset to 0 (S14). That is, in the case where the operation in the forced consumption mode is executed, the toner deterioration integrated value X which is the integrated value is reset to 0.

Figure 13:
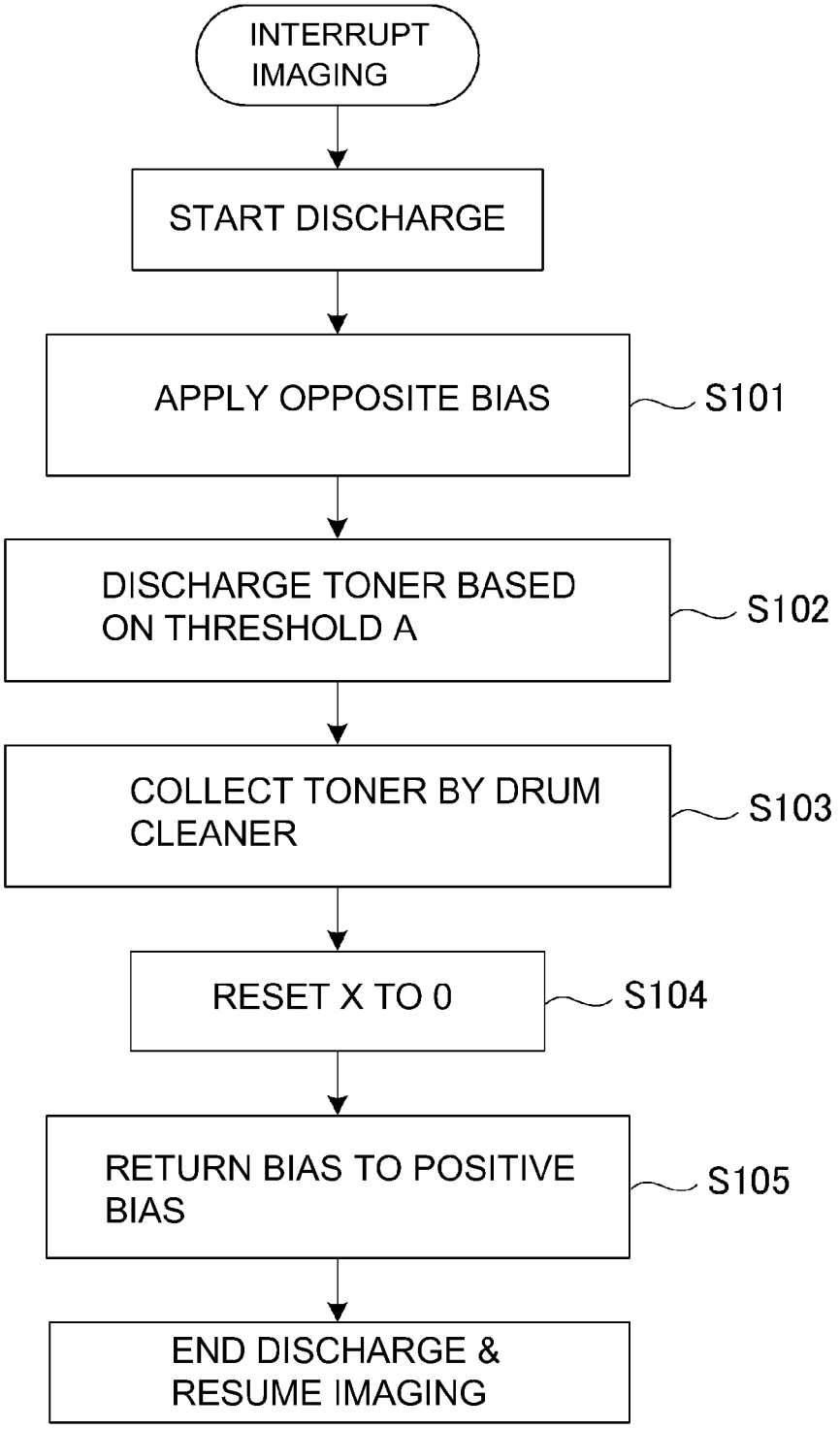
FIG. 13 is a flowchart showing the operation in the forced consumption mode according to the First Embodiment.

Here, the toner discharging operation (operation in the forced consumption mode) will be described with reference to FIG. 13. In the toner discharging operation, first, as the primary transfer bias, a transfer bias of an opposite polarity to that during the normal image formation (i.e., the transfer bias of an identical polarity to the charge polarity of the toner image on the photosensitive drum) is applied (S101). Next, the toner in the amount corresponding to the video count value (512 in this embodiment) equivalent to the discharge execution threshold A is discharged onto the photosensitive drum, so that supply of the toner in the amount corresponding to the amount of the toner used is made (S102). That is, by one operation in the forced consumption mode, the toner in the amount corresponding to the discharge execution threshold A which is the predetermined threshold is consumed. In this embodiment, irrespective of the setting of the toner deterioration threshold video count Vt, the toner consumption amount in the operation in the forced consumption mode is the amount corresponding to the discharge execution threshold A, and is the same.

Incidentally, during execution of the discharging operation, it is preferable that the discharging operation is controlled so that the developing sleeve is rotated at least one turn. The latent image, on the photosensitive drum, for the toner discharging may desirably be the whole surface solid image with respect to the longitudinal direction of the photosensitive drum in order to minimize the downtime due to the discharging.

Further, the toner discharged on the photosensitive drum is little transferred onto the intermediary transfer belt and remains on the photosensitive drum since the primary transfer bias has the opposite polarity to that during normal image formation, and is collected by a cleaner (S103). Here, the toner deterioration integrated value X is reset to zero (S104). Finally, the primary transfer bias is returned to the bias having the polarity during the normal image formation (S105), and the toner discharging operation is completed and is returned to the normal image forming operation.

Embodiment 1

Embodiment 1 as a specific example of this embodiment described above will be described using FIG. 14 and FIG. 15. In Embodiment 1, the case where images of the above-described "low-DUTY-black image chart" (Y=5%, M=5%, C=5%, K=1.5%) are continuously formed on 10000 sheets will be specifically considered. First, in the case where the image of the "low-DUTY-black image chart" is formed on one sheet, how the toner deterioration integrated value X in the toner discharge control in Embodiment 1 is calculated for each of the colors was shown in a table of FIG. 14. As shown in the table of FIG. 14, in the image formation of the "low-DUTY-black image chart", for Y (yellow), M (magenta) and C (cyan), the print ratios are always sufficiently high, and therefore the toner deterioration integrated value X is always 0.

On the other hand, for K (black), in the first half of continuous image formation (i.e., first 5000 sheets), the long term average print ratio is not less than 2% (treated as 100%). For this reason, in the first half, the toner deterioration threshold video count Vt is set at 5. Further, a video count value V(k)=8 for K (black) exceeds this toner deterioration threshold video count Vt=5 (Vt−V=−3), and therefore the toner deterioration integrated value X per (one) sheet is 0. On the other hand, in the latter half of the continuous image formation (from 5001-th sheet to 10000-th sheet), the long term average print ratio is 1.5% and is less than the predetermined print ratio of 2%, and therefore the toner deterioration threshold video count Vt is set at 10. Further, the video count value V(k)=8 is smaller than this toner deterioration threshold video count Vt=10 (Vt−V=+2), and therefore the toner deterioration integrated value per sheet increases from 0 to 2.

Further specifically, in the continuous image formation of the "low-DUTY-black image chart" of 10000 sheets of the A4-sized sheets, first, the toner discharging operation is not executed from 0-th sheet to 5000-th sheet. That is, until the 5000-th sheet, the long term average print ratio is 2% or more, and therefore, similarly as in the above-described mechanism, the toner deterioration integrated value is kept at 0. From 5001-th sheet to 10000-th sheet, the long term average print ratio is 1.5% less than 2.0%, and therefore the toner deterioration integrated value X per sheet is +2, so that the toner discharge is executed. Further, a frequency thereof is every 512/2=256 sheets (dropping of the fractional portion of the number) since the discharge execution threshold A is 512.

From the above, in Embodiment 1 in accordance with this embodiment, in the continuous image formation of the "low-DUTY-black image chart" of 10000 sheets of the A4-sized sheets, the image formation is interrupted about 19 times, and the toner discharge is executed. Further, by one toner discharging operation, the toner in the amount corresponding to the video count value of 512 consumed. Here, an example in which the toner deterioration threshold video count Vt is not changed depending on the long term average print ratio different from this embodiment and the operation in the forced consumption mode is executed in the same condition as in Embodiment 1 is Comparison Example 1. In Comparison Example 1, the toner deterioration threshold video count Vt was fixed at 10, and the operation in S6 and later in FIG. 12 was performed. That is, in Comparison Example 1, the toner discharging operation is executed using, as a reference developer amount, a value (2% in print ratio in Comparison Example 1) at which the toner deterioration does not exceed an assumed level even in the case where the image formation with the same print ratio is effected until the end of lifetime. In the case of such Comparison Example 1, the toner discharging operation has to be executed 39 times in total. Accordingly, in Embodiment 1 on the basis of this embodiment, the toner discharge amount can be remarkably reduced relative to Comparison Example 1.

Figure 15:
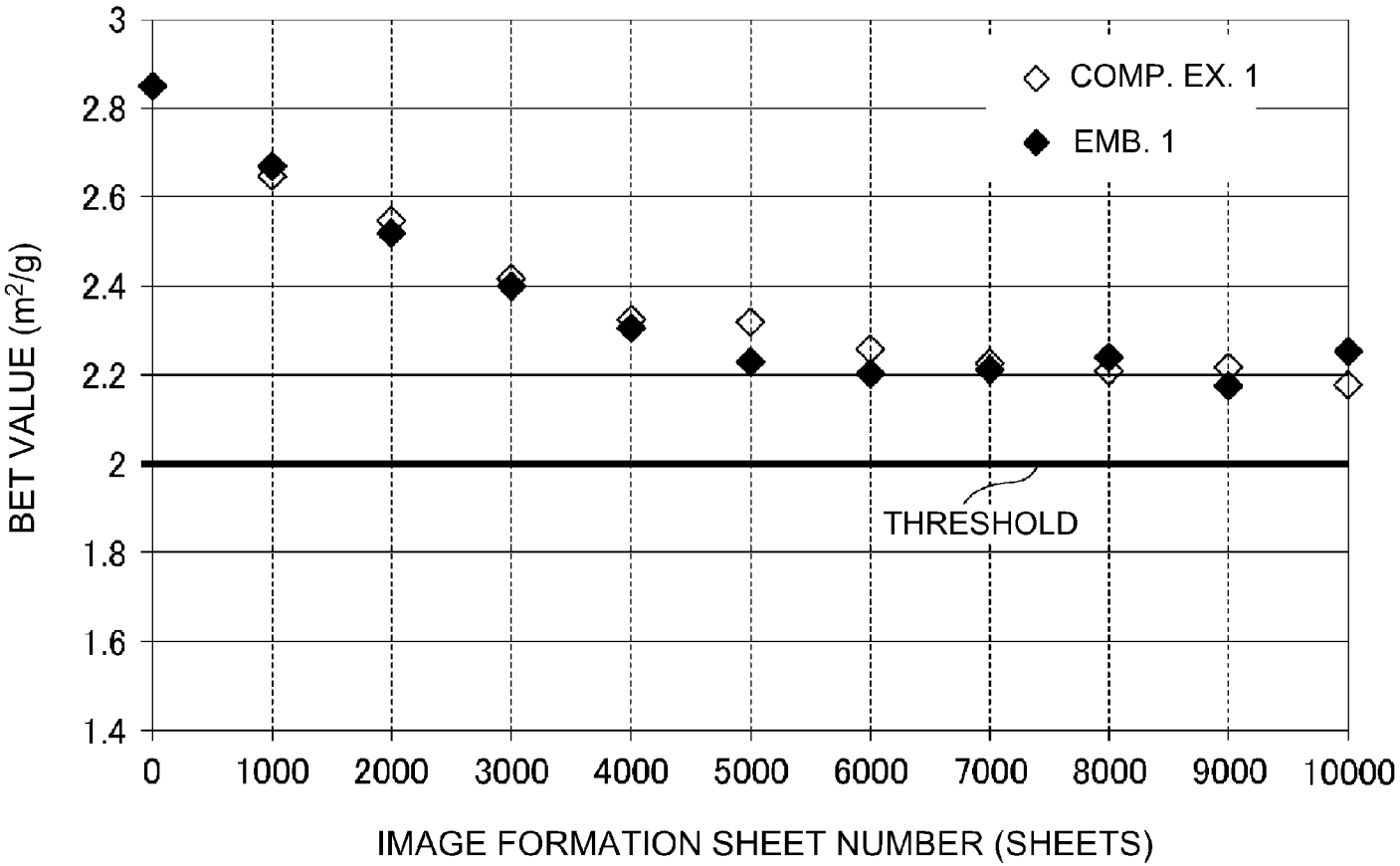
FIG. 15 is a diagram showing the BET value relative to the image formation sheet number in Embodiment 1 and Comparison Example 1.

Further, in Embodiment 1, during the image formation of 10000 sheets, deterioration of an image quality due to the toner deterioration was not generated. FIG. 15 shows progression of the toner BET value in the case where the control in Embodiment 1 and the control in Comparison Example 1 were effected, respectively. As a result of this, even at a minimum BET value, i.e., even in a state in which the toner deterioration most progressed, it is understood that the BET value is not below the BET value (threshold) of 2.0 $m^2/g$.

As described above, the control means in this embodiment executes the operation in the forced consumption mode on the basis of information on an average movement value of the amount of the toner consumed per first predetermined sheet number or the amount of the toner constituted per first predetermined driving time of the developing device and information on image ratio (print ratio) per second predetermined sheet number less than the first predetermined sheet number or a second predetermined driving time shorter than the first predetermined driving time of the developing device. Here, the first predetermined sheet number is, e.g., 5000 sheets, and the first predetermined driving time is, e.g., a driving time corresponding to 5000 sheets. Further, the second predetermined sheet number is the sheet number less than the above-described 5000 sheets and is, e.g., 1 sheet or 2 sheets, and the second predetermined driving time is a driving time corresponding to this sheet number. Further, the information on the image ratio is, e.g., the video count value.

Specifically, the case where after the last operation in the forced consumption mode is executed, the image with the same print ratio which is not more than the predetermined print ratio (predetermined print ratio (2% in this embodiment) will be considered. Here, the case where the image with the predetermined image ratio or less is formed is the case where the image with a low image ratio is formed, and for example, the case where the print ratio is 1.5%, 1.0% or the like which are not more than 2.0%. In this case, on the basis of the long term average print ratio (average movement value) immediately after the last operation in the forced consumption mode is executed, the amount of the toner consumed per unit driving time of the developing device by the operation in the forced consumption mode is controlled. More specifically, the control is effected so that the amount of the toner consumed per unit driving time of the developing device by the operation in the forced consumption mode is larger in the case where the long term average print ratio (average movement value) is smaller than the reference value (the above-described predetermined print ratio, 2% in this embodiment) immediately after the last operation in the forced consumption mode is executed than in the case where the long term average print ratio is larger than the reference value. Here, the increase in amount of the toner consumed per unit driving time of the developing device by the operation in the forced consumption mode includes the case where the amount itself of the toner consumed by the operation in the forced consumption mode, and in addition, the case where the amount itself of the toner consumed by one operation in the forced consumption mode is the same but the execution frequency of the operation in the forced consumption mode increases, and the like case.

Further, the control means in this embodiment effects, in other words, the following control. That is, a proportion occupied by a period in which the long term average print ratio (average movement value) is smaller than the reference value during a period from execution of the last operation in the forced consumption mode to execution of a subsequent operation in the forced consumption mode will be considered. The control means in this embodiment effects control so that the amount of the toner consumed per unit driving time of the developing device by the operation in the forced consumption mode in the case where the image with the same print ratio is formed is larger with a higher value of this proportion.

Embodiment 2

Next, Embodiment 2 as a specific example of this embodiment as described above will be described using FIG. 16 and FIG. 17. In Embodiment 1, the case where (hereinafter referred to as "very low-DUTY-black image chart" which Y=5%, M=5%, C=5%, K=0.5%) are continuously formed on 10000 sheets will be considered. First, in the case where the image of the "very low-DUTY-black image chart" is formed on one sheet, how the toner deterioration integrated value X in the toner discharge control in Embodiment 2 is calculated for each of the colors was shown in a table of FIG. 16. As shown in the table of FIG. 16, in the image formation of the "very low-DUTY-black image chart", for Y (yellow), M (magenta) and C (cyan), the print ratios are always sufficiently high, and therefore the toner deterioration integrated value X is always 0.

On the other hand, for K (black), in the first half of continuous image formation (i.e., first 5000 sheets), the long term average print ratio is not less than 2% (treated as 100%). For this reason, in the first half, the toner deterioration threshold video count Vt is set at 5. Further, a video count value V(k)=3 for K (black) is below this toner deterioration threshold video count Vt=5 (Vt−V=+2), and therefore the toner deterioration integrated value X per (one) sheet is +2. On the other hand, in the latter half of the continuous image formation (from 5001-th sheet to 10000-th sheet), the long term average print ratio is 0.5% and is less than the predetermined print ratio of 2%, and therefore the toner deterioration threshold video count Vt is set at 10. Further, the video count value V(k)=3 is smaller than this toner deterioration threshold video count Vt=10 (Vt−V=+7), and therefore the toner deterioration integrated value per sheet increases from +2 to +7.

Further specifically, in the continuous image formation of the "very low-DUTY-black image chart" of 10000 sheets of the A4-sized sheets, first, from 0-th sheet to 5000-th sheet, in the toner discharging operation, the long term average print ratio is 2% or more. For this reason, V(k)=3 is below the toner deterioration threshold video count Vt=5, and therefore the toner discharge is executed, and a frequency thereof is every 512/2=256 sheets (dropping of the fraction portion of the number) since the execution threshold A is 512.

Further, from 5001-th sheet to 10000-th sheet, the long term average print ratio is 1.0% (although the image print ratio is 0.5%, the amount of the toner corresponding to 1% is consumed by the toner discharge) and is less than 2.0%, and therefore the toner deterioration integrated value X per sheet is +5, so that the toner discharge is executed. Further, a frequency thereof is every 512/7=73 sheets (dropping of the fractional portion of the number) since the discharge execution threshold A is 512.

From the above, in Embodiment 2 in accordance with this embodiment, in the continuous image formation of the "very low-DUTY-black image chart" of 10000 sheets of the A4-sized sheets, the toner discharging operation in executed 19 times until 5000-th sheet in the first half and 68 times during 5000 sheets in the latter half, i.e., 87 times in total. Further, by one toner discharging operation, the toner in the amount corresponding to the video count value of 512 consumed. Here, an example in which the toner deterioration threshold video count Vt is not changed depending on the long term average print ratio different from this embodiment and the operation in the forced consumption mode is executed in the same condition as in Embodiment 2 is Comparison Example 2. In Comparison Example 2, the toner deterioration threshold video count Vt was fixed at 10, and the operation in S6 and later in FIG. 12 was performed. That is, in Comparison Example 2, the toner discharging operation is executed using, as a reference developer amount, a value (2% in print ratio in Comparison Example 2) at which the toner deterioration does not exceed an assumed level even in the case where the image formation with the same print ratio is effected until the end of lifetime. In the case of such Comparison Example 2, the toner discharging operation has to be executed 136 times in total. Accordingly, in Embodiment 2 on the basis of this embodiment, the toner discharge amount can be remarkably reduced relative to Comparison Example 2.

Figure 17:
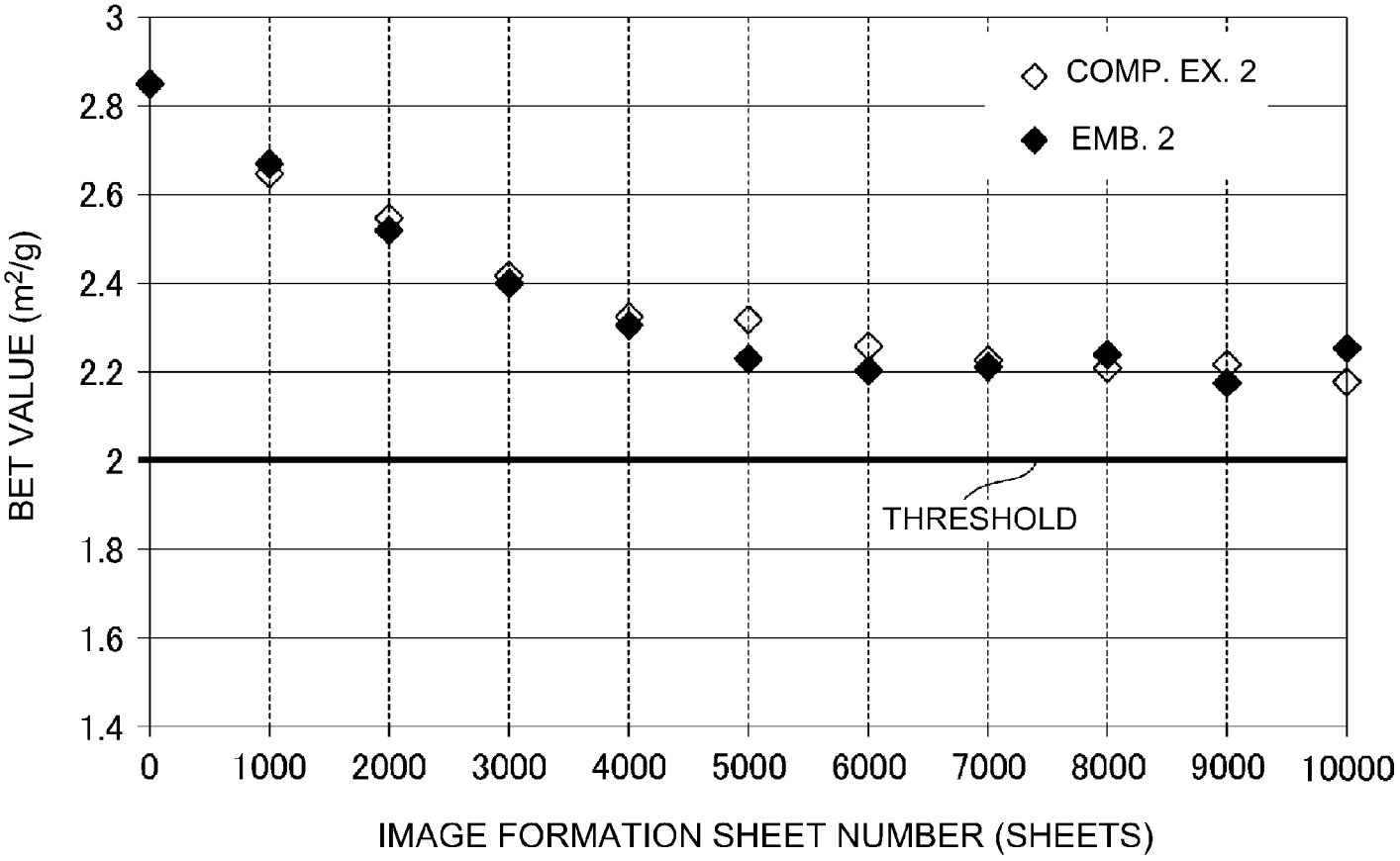
FIG. 17 is a diagram showing the BET value relative to the image formation sheet number in Embodiment 2 and Comparison Example 2.

Further, in Embodiment 2, during the image formation of 10000 sheets, deterioration of an image quality due to the toner deterioration was not generated. FIG. 17 shows progression of the toner BET value in the case where the control in Embodiment 2 and the control in Comparison Example 2 were effected, respectively. As a result of this, even at a minimum BET value, i.e., even in a state in which the toner deterioration most progressed, it is understood that the BET value is not below the BET value (threshold) of 2.0 $m^2/g$.

Embodiment 3

Next, Embodiment 3 as a specific example of this embodiment as described above will be described using FIG. 18 and FIG. 19. In Embodiment 3, the case where images of "low-DUTY-black image chart" and "medium-DUTY black image chart" in mixture for each of the colors of Y, M, C, K with a print ratio per (one) sheet are formed will be considered. Here, the "low-DUTY-black image chart" is, as described above, an image with Y=5%, M=5%, C=5%, K=1.5%. On the other hand, the "medium-DUTY black image ratio" is an image with Y=5%, M=5%, C=5%, K=10%.

In the case where the image of the "medium-DUTY black image chart" is formed on one sheet, how the toner deterioration integrated value X in the toner discharge control in Embodiment 1 is calculated for each of the colors was shown in a table of FIG. 18. As shown in the table of FIG. 18, in the image formation of the "medium-DUTY black image chart", the print ratios are always sufficiently high for all of the colors, and therefore the toner deterioration integrated value X is always 0.

As a mixing condition, in the continuous image formation of 10000 sheets of the A4-sized sheets, after the "low-DUTY-black image chart" was formed on 5000 sheets, the "medium-DUTY black image chart" was formed on 500 sheets, and thereafter the "low-DUTY-black image chart" was formed on 4500 sheets.

First, in the case where the image of the "low-DUTY-black image chart" is formed on one sheet, how the toner deterioration integrated value X in the toner discharge control in Embodiment 3 is calculated for each of the colors is the same as the above-described case shown in FIG. 14. As shown in the table of FIG. 14, in the image formation of the "low-DUTY-black image chart", for Y (yellow), M (magenta) and C (cyan), the print ratios are always sufficiently high, and therefore the toner deterioration integrated value X is always 0. As regards K (black), in the first half of continuous image formation, the long term average print ratio is not less than 2%, and therefore a video count value V(k)=8 for K (black) exceeds this toner deterioration threshold video count Vt=5 (Vt−V=−3), and therefore the toner deterioration integrated value X per (one) sheet is 0.

So far, control similar to that in Embodiment 1 is effected. Then, image formation of the "medium-DUTY black image chart" on 500 sheets is effected. In the image formation of the "medium-DUTY black image chart", the print ratios are always high for all of the colors, and therefore the toner deterioration integrated value X is always 0. A difference from Embodiment 1 is that the black print ratio in the medium-DUTY black image chart is 10% which is high and therefore the long term average print ratio is 2% or more also in the latter half 4500 sheets. Accordingly, also in the latter half of the continuous image formation, the video count value V(k)=8 exceeds the toner deterioration threshold video count Vt=5, and therefore the toner deterioration integrated value X per sheet is 0.

Further specifically, first, the toner discharging operation is not executed from 0-th sheet to 5000-th sheet of the "low-DUTY-black image chart". That is, until the 5000-th sheet, the long term average print ratio is 2% or more, and therefore, similarly as in the above-described mechanism, the toner deterioration integrated value is kept at 0. At the time of the 5000-th sheet, immediately before the long term average print ratio is below the predetermined print ratio of 2%, the image formation is switched to the image formation of the "medium-DUTY black image chart" with the black print ratio of 10% on 500 sheets. For this reason, the long term average print ratio exceeds 2% (at the time of 5500 sheets), the long term average print ratio is about 2.4%. Thereafter, from 5501-th sheet to 10000-th sheet, the image chart is switched to the "low-DUTY-black image chart", but the long term average print ratio is kept at 2% or more, and therefore similarly as in the above-described mechanism, the toner deterioration integrated value X is kept at 0. Incidentally, the long term average print ratio is below 2% at the time of 10100-th sheet.

From the above, in Embodiment 3 in accordance with this embodiment, the number of times of the black toner discharge control is 0 times. Here, an example in which the toner deterioration threshold video count Vt is not changed depending on the long term average print ratio different from this embodiment and the operation in the forced consumption mode is executed in the same condition as in Embodiment 3 is Comparison Example 3. In Comparison Example 3, the toner deterioration threshold video count Vt was fixed at 10, and the operation in S6 and later in FIG. 12 was performed. That is, in Comparison Example 3, the toner discharging operation is executed using, as a reference developer amount, a value (2% in print ratio in Comparison Example 2) at which the toner deterioration does not exceed an assumed level even in the case where the image formation with the same print ratio is effected until the end of lifetime. In the case of such Comparison Example 3, the toner discharging has to be executed 37 times in total. Accordingly, in Embodiment 3 on the basis of this embodiment, the toner discharge amount can be remarkably reduced relative to Comparison Example 3. As use from a user, it is predicted that the case where the low-DUTY-image and the medium-DUTY-image (normal image) are used in mixture as in Embodiment 3 is larger than the case where only the low-DUTY-image is continuously formed as in Embodiments 1 and 2. Accordingly, in such a case, particularly, an effect of this embodiment is achieved.

Figure 19:
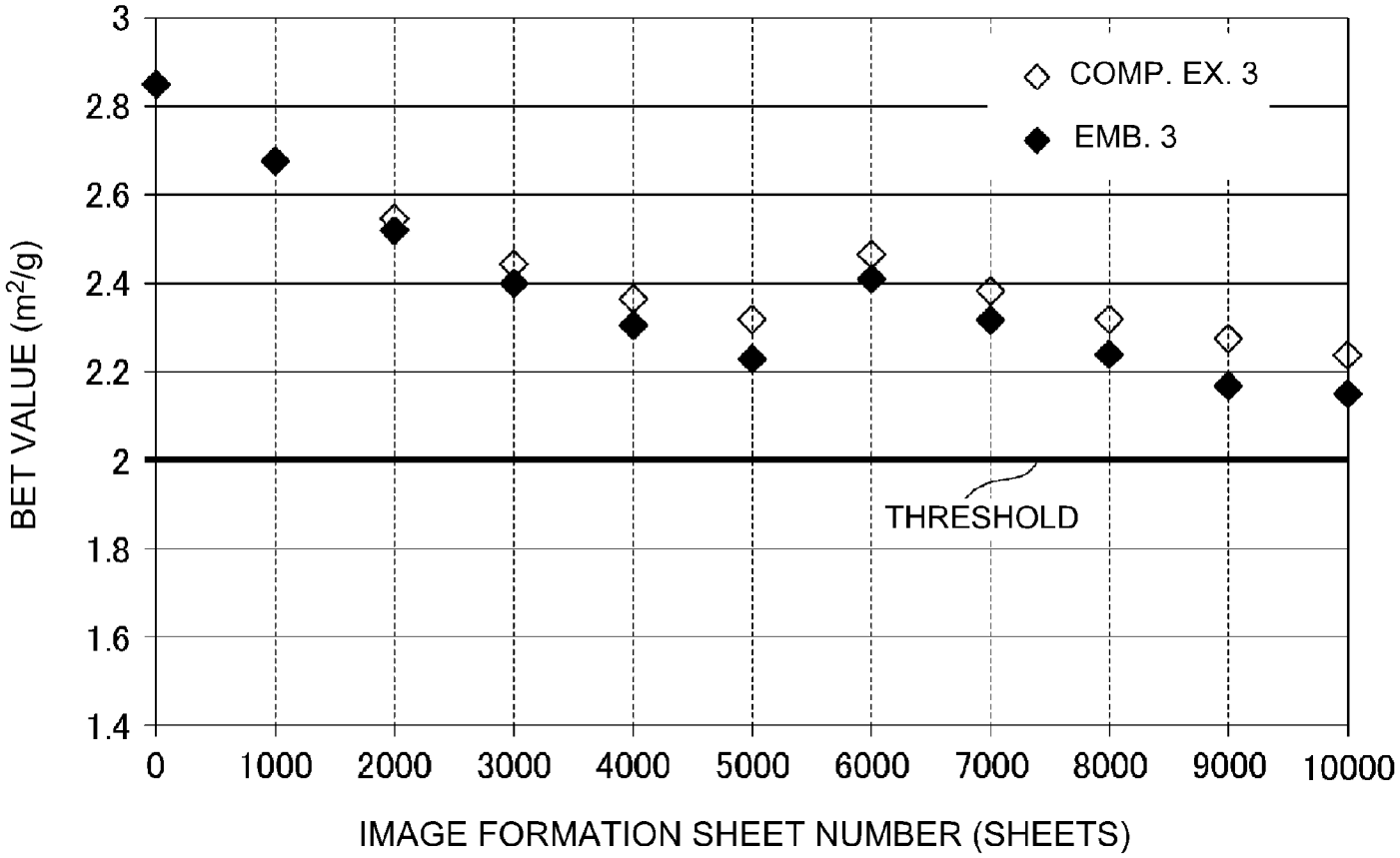
FIG. 19 is a diagram showing the BET value relative to the image formation sheet number in Embodiment 3 and Comparison Example 3.

Further, in Embodiment 3, during the image formation of 10000 sheets, deterioration of an image quality due to the toner deterioration was not generated. FIG. 19 shows progression of the toner BET value in the case where the control in Embodiment 3 and the control in Comparison Example 3 were effected, respectively. As a result of this, even at a minimum BET value, i.e., even in a state in which the toner deterioration most progressed, it is understood that the BET value is not below the BET value (threshold) of 2.0 $m^2/g$.

As described above, according to this embodiment, in a constitution in which the operation in the forced consumption mode for preventing the toner detection, the toner discharge in a proper amount with no excess and no deficiency can be realized correspondingly to the degree of toner deterioration with a proper interval in which there is no defect in terms of the image density or the like.

That is, in the case of this embodiment, depending on information (long term average print ratio) on the average toner consumption amount, the reference value (toner deterioration threshold video count Vt) for calculating the difference from the consumption value (video count value V) is changed. For this reason, the forced consumption of the toner can be appropriately performed depending on (the degree of) the toner detection.

Specifically, in the case where the long term average print ratio is 2% (the value corresponding to the predetermined reference toner consumption amount) or more, the toner deterioration threshold video count Vt is set at a low value, and therefore, the frequency of execution of the operation in the forced consumption mode becomes low. In this case, it would be considered that the toner detection does not progress so, and therefore, the frequency of the execution of the operation in the forced consumption mode lowers, so that it is possible to suppress consumption of the toner more than necessary.

For example, as in the case where image formation with the low image ratio is continuously effected, in the case where the long term average print ratio is less than 2%, the toner deterioration threshold video count Vt becomes high, and therefore the frequency of the execution of the operation in the forced consumption mode becomes high. That is, when the toner deterioration threshold video count Vt increases, a difference between the toner deterioration threshold video count Vt and the video count value V increases, so that an integrated value (toner deterioration integrated value X) is liable to become larger than the predetermined threshold (discharge execution threshold A). For this reason, the frequency of the execution of the operation in the forced consumption mode becomes high. In this case, it would be considered that the toner deterioration progresses, and therefore, the toner deterioration can be appropriately suppressed by increasing the frequency of the execution of the operation in the forced consumption mode.

On the other hand, for example, as in the case where the image formation with a high image ratio is effected during execution of the continuous image formation with a low image ratio, in the case where the long term average print ratio is 2% or more, the toner deterioration threshold video count Vt becomes low. For this reason, in this case, compared with the case where the long term average print ratio is less than 2%, the frequency of execution of the operation in the forced consumption mode becomes low. In this case, it would be considered that the toner detection does not progress so, and therefore, the frequency of the execution of the operation in the forced consumption mode lowers, so that it is possible to suppress consumption of the toner more than necessary.

In other words, in this embodiment, control is effected so that the frequency of the execution of the operation in the forced consumption mode is higher in a period in which the long term average print ratio is less than the predetermined print ratio of 2% than in a period in which the long term average print ratio is not less than the predetermined print ratio of 2%. Incidentally, in either period, the image formation is effected with the same image ratio (the same print ratio). For example, in the case where the image formation of 5000 sheets is effected at the image ratio of 1.5%, the predetermined print ratio is less than 2% at the long term average print ratio of 1.5%. On the other hand, in the case where the image formation of 5000 sheets is effected at the image ratio of 5%, the predetermined print ratio is not less than 2% at the long term average print ratio of 5%. When both cases are compared, as is apparent from the description mentioned above, the frequency of the execution of the operation in the forced consumption mode is higher in the former image formation period than in the latter image formation period. Incidentally, between the former case and the latter case, it is preferable that the amount of the toner consumed by one operation in the forced consumption mode is the same.

Incidentally, it would be also considered that the predetermined threshold (execution threshold A) is changed depending on information (long term average print ratio) on the average toner consumption amount. For example, in the case where the information on the average toner consumption amount is not less than a value corresponding to the predetermined reference toner consumption amount, by increasing the predetermined threshold, it is possible to lower the frequency of the execution of the operation in the forced consumption mode. However, when the amount of the toner consumed by the operation in the forced consumption mode increases, the charge amount of the toner in the developing device largely changes between before and after the execution of the operation in this mode, so that this change has a large influence on the density of the image to be formed. Accordingly, it is not preferable that the predetermined threshold is changed depending on the long term average print ratio.

Incidentally, the amount of the toner consumed by the operation in the forced consumption mode is made constant irrespective of the predetermined threshold, and the predetermined threshold may also be changed depending on the long term average print ratio, but in this case, there is a possibility that the toner deterioration cannot be sufficiently restored. That is, the predetermined threshold is a value as an index for restoring the toner deterioration, and when the predetermined value is small, the frequency of the execution of the operation in the forced consumption mode is high, and when the predetermined value is large, this frequency is low. For this reason, there is a possibility that when the amount of the toner consumed in the case where the execution frequency of the operation in the forced consumption mode is high is large, the toner is consumed more than necessary and that when the amount of the toner consumed in the case where the execution frequency of the operation in the forced consumption mode is low is small, the toner deterioration cannot be sufficiently restored.

Second Embodiment

Figure 20:
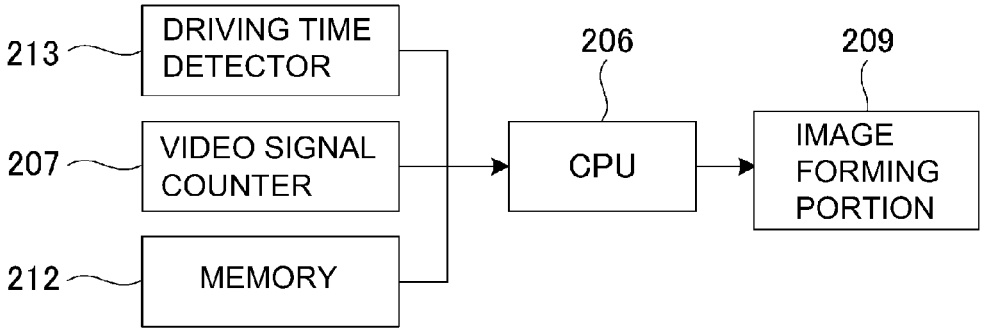
FIG. 20 is a control block diagram of an operation in a forced consumption mode according to a Second Embodiment of the present invention.

The Second Embodiment of the present invention will be described using FIG. 20 to FIG. 22. In the above-described First Embodiment, the toner discharge control was described based on the premise that the developing sleeve drive during the image formation is made for a driving time required for only the image formation. On the other hand, in this embodiment, toner discharge control in which interrupt control such as patch density control is made during the image formation and in which the case where the developing sleeve is driven for not less than the driving time required for the image formation is taken into consideration will be described. Incidentally, other constitutions and basic contents of the operation in the forced consumption mode are similar to those in the First Embodiment, and therefore, redundant description and illustration will be omitted or briefly made, and the same constituent elements are represented by the same reference symbols, and in the following, a point different from the First Embodiment will be principally described.

In the case of this embodiment, in addition to the control black diagram of FIG. 10 in the First Embodiment, a developing sleeve driving time detecting portion 213 is provided. The CPU 206 discriminates propriety of the execution of the operation in the forced consumption mode, in accordance with a flow of FIG. 12 described below, from information of the developing sleeve driving time detecting portion 213 in addition to the video count value acquired by the video signal counting portion 207 and the information stored in the memory 212. In this embodiment, the developing sleeve driving time detecting portion 213 counts a rotation driving time of the developing sleeve in a period from the last calculation of the video count value V to current calculation of the video count value V. Then, the CPU 206 calculates a value ($\alpha \times Vt$) obtained by multiplying the toner deterioration threshold video count Vt by a coefficient $\alpha$ obtained by dividing the driving time by a reference driving time which is a rotation driving time, per image formation of one sheet, of the developing device. Then, this difference is integrated as a toner deterioration integrated value X.

Next, details of discrimination of propriety of execution of the operation in the forced consumption mode in this embodiment will be described with reference to FIG. 21. As a precondition, a concept of the operation in the forced consumption mode for each of the colors is the same. Therefore, the colors are omitted from description in the following flowcharts and the like in some cases, but in those cases, common control is effected for each of the colors. In this embodiment, as an easy-to-understand example, the case where such an image that the print ratios per (one) sheet for the colors of Y, M, C and K are 5% for Y, 5% for M, 5% for C and 1.5% for K (hereinafter, this image is referred to as a "low-duty-black image chart") is continuously formed on A4-sized sheets is considered.

Figure 12:
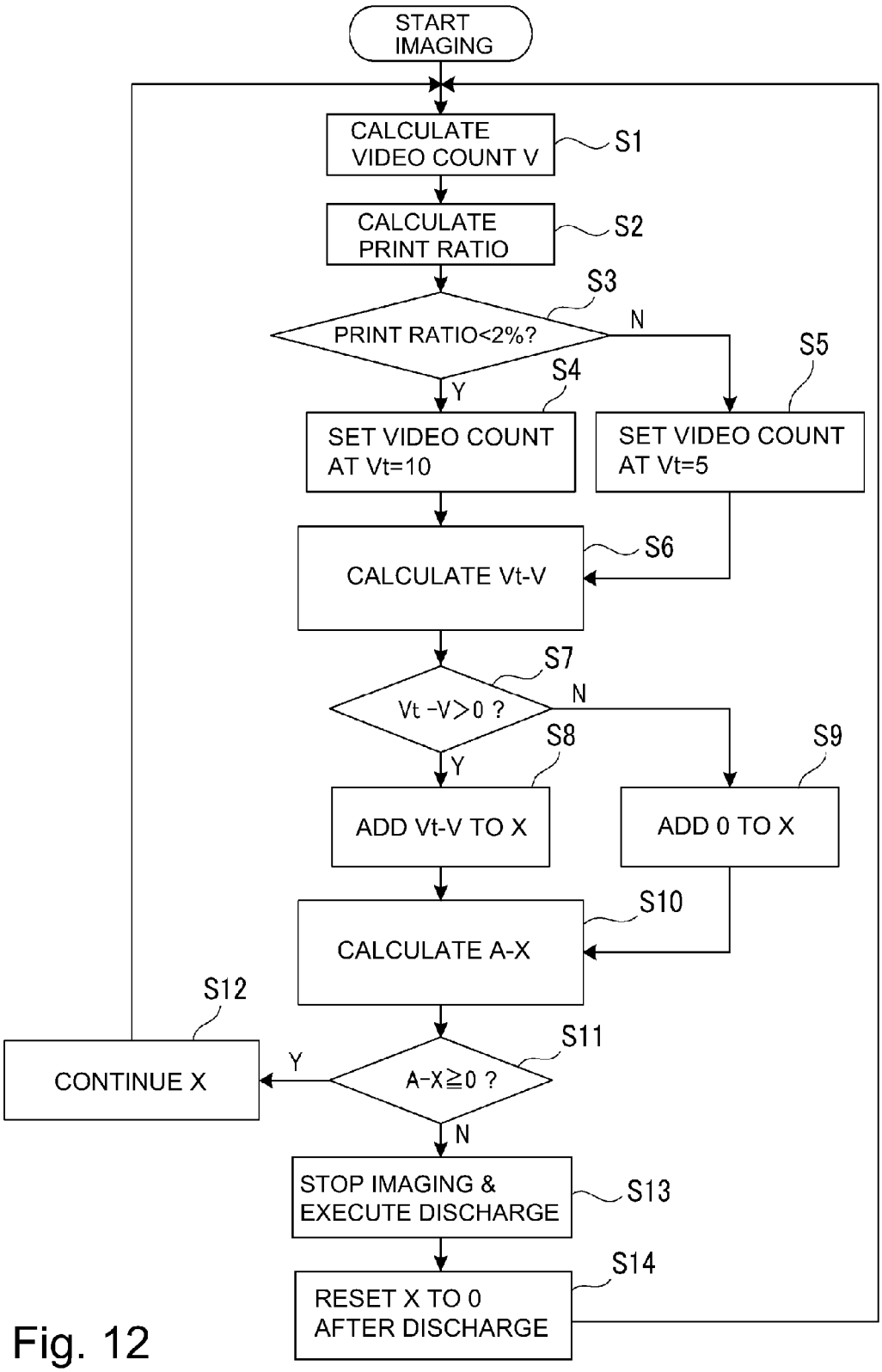
FIG. 12 is a flowchart for making discrimination of execution property of the operation in the forced consumption mode according to the First Embodiment.
Figure 21:
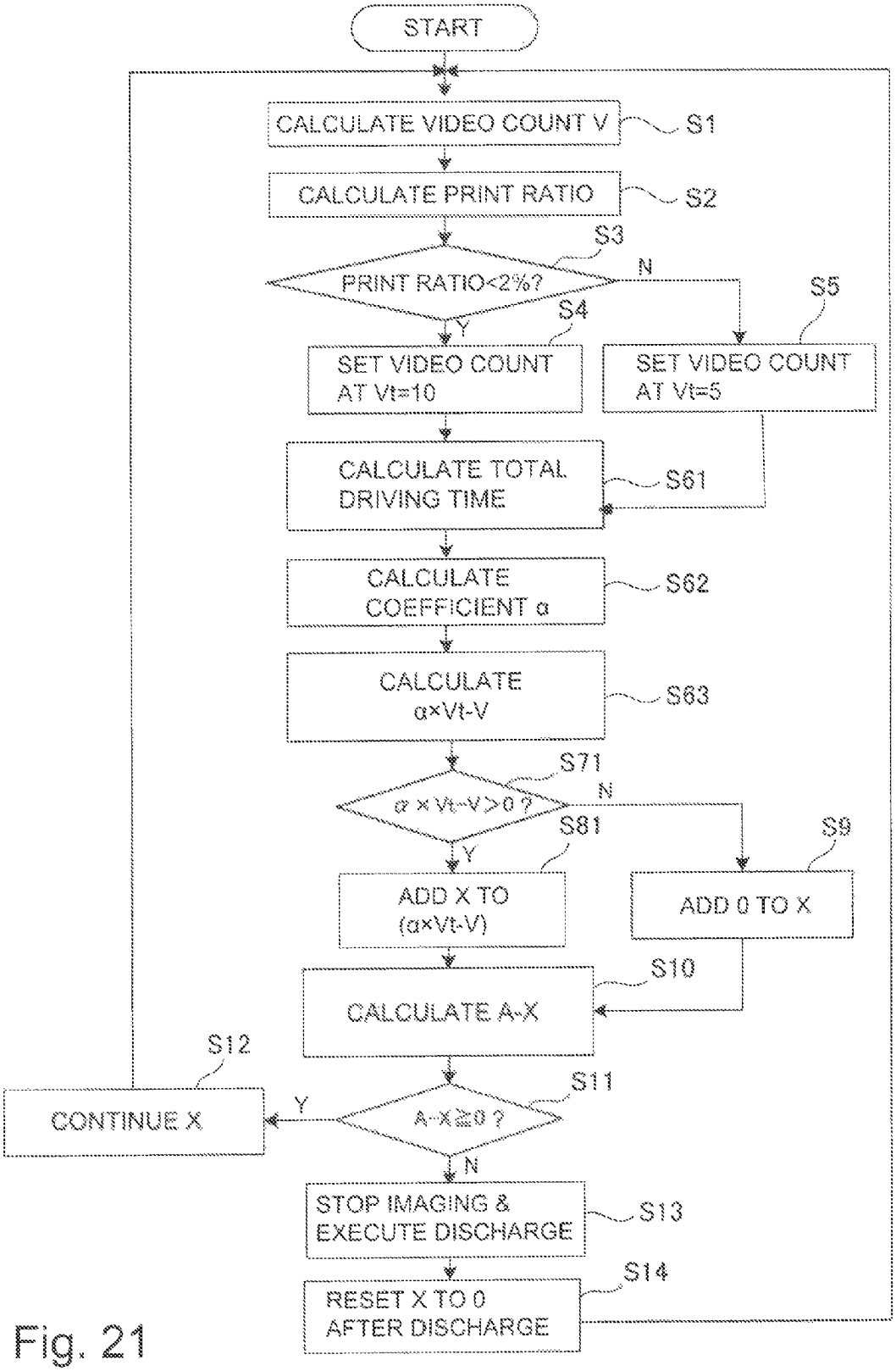
FIG. 21 is a flowchart showing the operation in the forced consumption mode according to the Second Embodiment.
Figure 22:
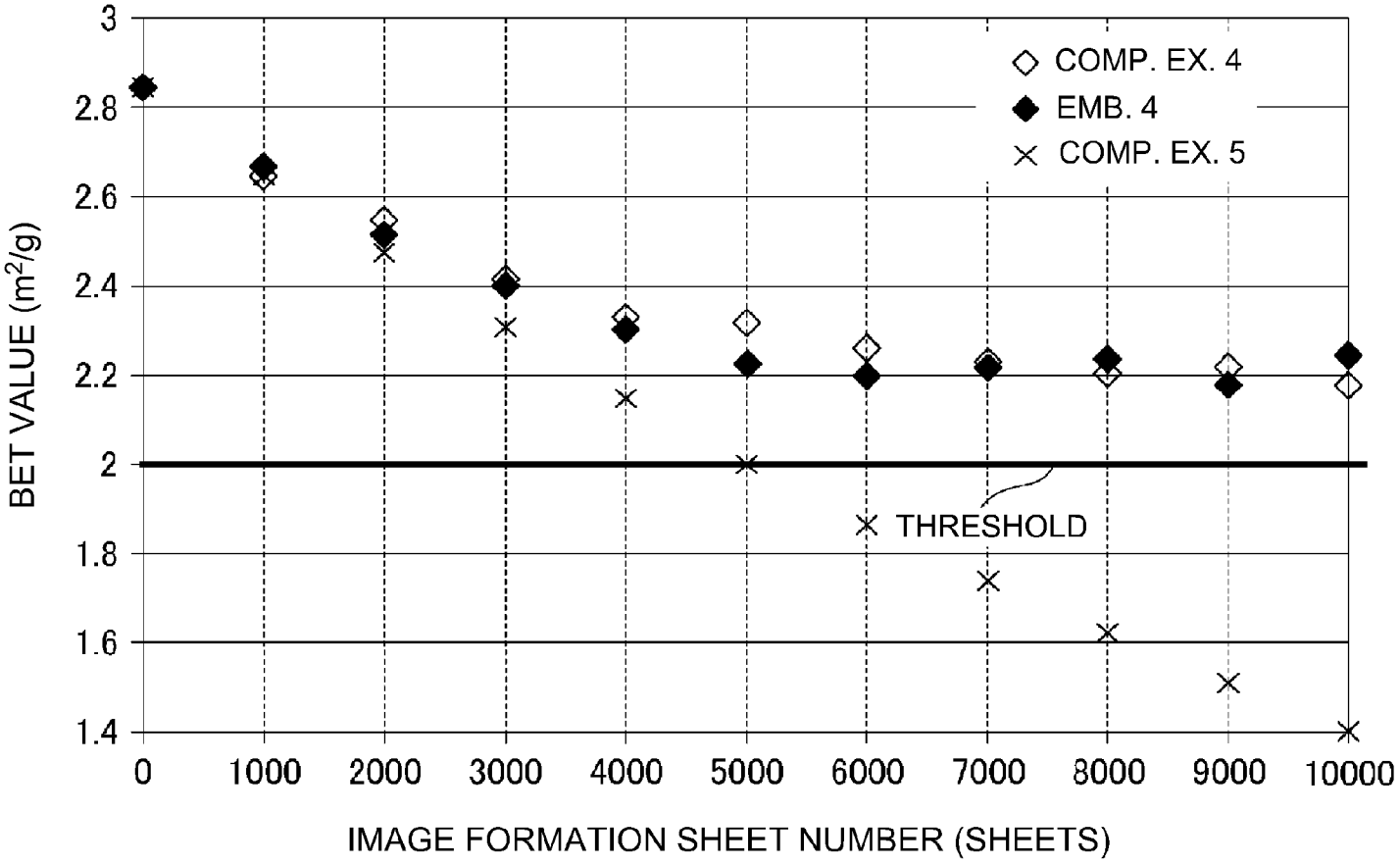
FIG. 22 is a diagram showing the BET value relative to the image formation sheet number in Embodiment 4 according to the Second Embodiment and Comparison Examples 4, 5.

Incidentally, in FIG. 21, S1-S5 and S9-S14 are similar to those of the flow of FIG. 12 in the First Embodiment. For this reason, in the following, a portion different from the flow of FIG. 12 will be principally described. When the toner deterioration threshold video count Vt is set in S3-S5, calculation of a developing sleeve driving time coefficient $\alpha$ is made. First, a total driving time of the developing sleeve from the time of calculation of the last video count V to the time of calculation of the current vide count V is calculated (S61). Then, the calculated total developing sleeve driving time is divided by a predetermined reference developing sleeve driving time (reference driving time), so that the developing sleeve driving time coefficient $\alpha$ is calculated (S62). Incidentally, the reference sleeve driving time is defined as a driving time required for image formation of one sheet. Accordingly, in the case where interrupt control is not effected during the image formation or in the case where the developing sleeve drive is at rest during the interrupt control, the total driving time of the developing sleeve and the reference developing sleeve driving time have the same value, so that $\alpha$ is 1. Incidentally, in this embodiment, the reference developing sleeve driving time is set at 1 sec, and the total developing sleeve driving time is 3 sec (i.e., the developing sleeve drive by the interrupt control in a time corresponding to 2 sec is made), so that description will be made citing the case of $\alpha=3$ as an example.

Next, a difference ($\alpha \times Vt-V$) between the video count value V and the above-described developing sleeve driving time coefficient $\alpha \times$the toner deterioration threshold video count Vt is calculated (S63). Then, a sign (positive/negative) of the difference $\alpha Vt-V$ is discriminated (S71). That is, whether or not the difference is $\alpha Vt-V>0$ is discriminated, and in the case where the difference is a positive value ($\alpha Vt-V>0$, Y of S71), the print ratio is low and thus a state in which the toner deterioration progresses is formed, and therefore the difference is integrated and the integrated value, i.e., the toner deterioration integrated value X is acquired. In other words, the difference $\alpha Vt-V$ is added to the toner deterioration integrated value X (S81). Incidentally, when $\alpha=1$, $1 \times Vt-V$ and therefore calculation similar to that in the First Embodiment is made. The reason why the toner deterioration threshold video count Vt is multiplied by $\alpha$ is that corresponding to an increase in developing sleeve driving time, the toner deterioration progresses proportionally. On the other hand, when the difference is the negative value ($\alpha Vt-V<0$) and the difference is 0 (N of S71), the print ratio is high and a state in which the toner deterioration does not progress is formed, and therefore 0 is added to the toner deterioration threshold video count X (S9). Thereafter, the sequence is similar to that in FIG. 12 in the First Embodiment.

Incidentally, during the interrupt control, for example, in the case where toner consumption is made by a density control patch, a toner supply control patch, a misregistration correction patch and the like, during the calculation of the video count value V in S1, the video count value V is calculated by adding a video count value corresponding to an amount of the toner consumption.

Embodiment 4

Embodiment 4 as a specific example of this embodiment described above will be described. In Embodiment 1, the case where images of the above-described "low-DUTY-black image chart" (Y=5%, M=5%, C=5%, K=1.5%) are continuously formed on 10000 sheets will be specifically considered. Description will be made using, as an example, control in which a frequency of the interrupt control is such that the interrupt control is effected simply every time and there is no toner consumption.

The interrupt control is effected very time, and therefore the developing sleeve driving time coefficient $\alpha$ is always set at 3. For K (black), in the first half of continuous image formation (i.e., first 5000 sheets), the long term average print ratio is not less than 2% (treated as 100%). For this reason, in the first half, the toner deterioration threshold video count Vt is set at 5. Further, a video count value V(k)=8 for K (black) is below $\alpha$ (=3)×toner deterioration threshold video count Vt(5)=15. For this reason, the toner deterioration integrated value X per (one) sheet is 7. On the other hand, in the latter half of the continuous image formation (from 5001-th sheet to 10000-th sheet), the long term average print ratio is 1.5% and is less than the predetermined print ratio of 2%, and therefore the toner deterioration threshold video count Vt is set at 10. Further, the video count value V(k)=8 is below $\alpha$ (=3)×toner deterioration threshold video count Vt(10)=30. For this reason, the toner deterioration integrated value per sheet increases from +7 to +22.

Further specifically, in the continuous image formation of the "low-DUTY-black image chart" of 10000 sheets of the A4-sized sheets, first, from 0-th sheet to 5000-th sheet, the long term average print ratio is 2% or more and therefore the toner deterioration integrated value x per sheet is +7. For this reason, the toner discharging operation is performed, and a frequency thereof is every 512/7=73 sheets (dropping of the fraction portion of the number) since the discharge execution threshold A is 512. Further, from 5001-th sheet to 10000-th sheet, the long term average print ratio is 1.5% less than 2.0%, and therefore the toner deterioration integrated value X per sheet is +22, and therefore the toner discharge is executed, and a frequency thereof is every 512/22=23 sheets (dropping of the fractional portion of the number) since the discharge execution threshold A is 512.

From the above, in Embodiment 4 in accordance with this embodiment, in the continuous image formation of the "low-DUTY-black image chart" of 10000 sheets of the A4-sized sheets, the image formation is interrupted about 285 times, and the toner discharge is executed. Further, by one toner discharging operation, the toner in the amount corresponding to the video count value of 512 is consumed.

Here, an example in which the toner deterioration threshold video count Vt is not changed depending on the long term average print ratio different from this embodiment and the operation in the forced consumption mode is executed in the same condition (in consideration of the developing sleeve driving time during the interrupt control) as in Embodiment 4 is Comparison Example 4. In Comparison Example 4, the toner deterioration threshold video count Vt was fixed at 10, and the operation in S61 and later in FIG. 21 was performed. That is, in Comparison Example 4, the toner discharging operation is executed using, as a reference developer amount, a value (2% in print ratio in Comparison Example 4) at which the toner deterioration does not exceed an assumed level even in the case where the image formation with the same print ratio is effected until the end of lifetime. In the case of such Comparison Example 4, the toner discharging operation has to be executed 434 times in total. Accordingly, in Embodiment 4 on the basis of this embodiment, the toner discharge amount can be remarkably reduced relative to Comparison Example 4.

Further, in Embodiment 4, during the image formation of 10000 sheets, deterioration of an image quality due to the toner deterioration was not generated. FIG. 22 shows progression of the toner BET value in the case where the control in Embodiment 4 and the control in Comparison Example 4 were effected, respectively. As a result of this, even at a minimum BET value, i.e., even in a state in which the toner deterioration most progressed, it is understood that the BET value is not below the BET value (threshold) of 2.0 $m^2/g$.

Incidentally, an example in which the toner deterioration threshold video count Vt is not changed depending on the long term average print ratio different from this embodiment and the developing sleeve driving time is also not considered is Comparison Example 5. In the case of such a Comparison Example 5, similarly as in the case described in Comparison Example 1 for the above-described First Embodiment, the frequency of the toner discharging operation is kept at 39 times. However, in the case of Comparison Example 5, the toner deterioration corresponding to the developing sleeve driving time required for the interrupt control is not considered, and therefore, as shown in FIG. 22, the toner deterioration progresses, so that the image defect generated when the image formation sheet number roughly exceeded 5000 sheets.

In the case of this embodiment, as described above, the operation in the forced consumption mode is executed in consideration of the developing sleeve driving time, and therefore, control move corresponding to the toner deterioration can be controlled, so that it is possible to suppress the toner discharge amount while suppressing the generation of the image defect.

Incidentally, in the description in the above-described embodiments, the video count is used as the consumption amount depending on the amount of the toner consumed every predetermined unit of image formation and as the reference value set for the predetermined unit, but the present invention is not limited thereto. That is, the amount of the toner consumed with the image formation may only be required to be determined.

INDUSTRIAL APPLICABILITY

According to the present invention, there is provided an image forming apparatus capable of properly effecting forced consumption of the toner depending on the toner deterioration even immediately after installation of a new developing device and even after images with a high print ratio are outputted in a large amount.

EXPLANATION OF SYMBOLS

101 (101Y, 101M, 101C, 101K) . . . photosensitive drum (image bearing member)/104 (104Y, 104M, 104C, 104K) . . . developing device/24 . . . developing sleeve (developer carrying member)/30 . . . toner supplying device (supplying means)/206 . . . CPU (control means, difference calculating means, integrating means, executing means)

The invention claimed is:

1. An image forming apparatus comprising:

an image bearing member;

a developing device configured to develop, with toner, an electrostatic latent image formed on said image bearing member; and a controller capable of executing an operation in a forced consumption mode in which the toner, with which the electrostatic latent image is developed on said image bearing member by said developing device, is consumed without being transferred onto a recording material, wherein said controller includes i) a difference calculating portion configured to calculate a difference between an image amount which is a video count value, and a reference value, ii) an integrating portion configured to integrate the difference to acquire an integrated value, and iii) an executing portion configured to execute the operation in the forced consumption mode when the integrated value reaches a predetermined threshold, and wherein the reference value is set i) at a first reference value when information on an average image amount per predetermined image forming number or per predetermined driving time of said developing device is less than a value corresponding to a predetermined reference image amount, and is set ii) at a second reference value lower than the first reference value when the information on the average image amount is not less than the predetermined reference image amount.

2. An image forming apparatus according to claim 1, wherein said controller uses the second reference value as the reference value irrespective of the average image amount in a period from an initial state of said developing device until an image formation number is the predetermined image forming number or in a period from the initial state of said developing device until a driving time is the predetermined driving time.

3. An image forming apparatus according to claim 1, wherein said developing device includes a developer carrying member which is configured to carry a developer containing the toner, which is rotatable, and which is configured to develop an electrostatic latent image formed on said image bearing member with the toner in the carried developer, and wherein said controller calculates a difference between a value obtained by multiplying the reference value by a coefficient obtained by dividing a rotation driving time of said developer carrying member in a period from calculation of a last image amount to calculation of a current image amount by a reference driving time, which is a rotation driving time of said image bearing member per one image formation, and the current image amount, and integrates the difference by said integrating portion.

4. An image forming apparatus according to claim 3, wherein said controller resets the integrated value to 0 when the operation in the forced consumption mode is executed.

5. An image forming apparatus according to claim 1, wherein said difference calculating portion calculates the difference by subtracting the image amount from the reference value, and wherein said integrating portion adds 0 to the integrated value when the difference is a negative value and adds the difference to the integrated value when the difference is another value.

6. An image forming apparatus according to claim 1, wherein said controller causes said developing device to consume the toner in an amount corresponding to the predetermined threshold in the operation in the forced consumption mode.

7. An image forming apparatus comprising:

an image bearing member;

a developing device configured to develop, with toner, an electrostatic latent image formed on said image bearing member; and a controller capable of executing an operation in a forced consumption mode in which the toner, with which the electrostatic latent image is developed on said image bearing member by said developing device, is consumed without being transferred onto a recording material, wherein the controller is capable of executing the operation in a first mode of the forced consumption mode based on a value corresponding to an image amount which is a video count value per image and a first reference value corresponding to the image amount per image when an average image amount per predetermined image forming number or per predetermined driving time of said developing device is less than a predetermined reference image amount, and executing the operation in a second mode of the forced consumption mode based on the value corresponding to the image amount per image and a second reference value corresponding to the image amount per image and different from the first reference value when the average image amount is not less than the predetermined reference image amount, and wherein intervals between the operations executed in the first mode in a case where image formation with less than the predetermined reference image amount is continuously effected are shorter than intervals between the operations executed in the second mode in a case where image formation with equal or more than the predetermined reference image amount is continuously effected.

8. An image forming apparatus according to claim 7, wherein the controller is capable of executing the operation in the first mode based on a difference between the value corresponding to the image amount per image and the first reference value and executing the operation in the second mode based on a difference between the value corresponding to the image amount per image and the second reference value

9. An image forming apparatus according to claim 8, wherein the first reference value is larger than the second reference value.

10. An image forming apparatus according to claim 8, wherein the controller is capable of executing the operation in the first mode when an integrated value calculated from a value by which the value corresponding to the image amount per image exceeded the first reference value reaches a first predetermined value, and executing the operation in the second mode when the integrated value calculated from a value by which the value corresponding to the image amount per image exceeded the second reference value reaches a second predetermined value.

11. An image forming apparatus according to claim 10, wherein the first predetermined value is the same as the second predetermined value.

12. An image forming apparatus according to claim 10, wherein the integrated value is reset after the integrated value reaches the first or second predetermined value.

13. An image forming apparatus according to claim 10, wherein a calculated method using the value corresponding to the image amount per image and the first reference value is the same as a calculated method using the value corresponding to the image amount per image and the second reference value.

14. An image forming apparatus comprising:

an image bearing member;

a developing device configured to develop, with toner, an electrostatic latent image formed on said image bearing member; and a controller capable of executing an operation in a forced consumption mode in which the toner, with which the electrostatic latent image is developed on said image bearing member by said developing device, is consumed without being transferred onto a recording material, wherein the controller is capable of executing the operation in a first mode of the forced consumption mode based on a value corresponding to an image amount which is a video count value per image and a first reference value corresponding to the image amount per image when an average image amount per first predetermined image forming number or per predetermined driving time of said developing device is less than a predetermined reference image amount, and executing the operation in a second mode of the forced consumption mode based on the value corresponding to the image amount per image and a second reference value corresponding to the image amount per image and different from the first reference value when the average image amount is not less than the predetermined reference image amount, and wherein a number of times of the operations executed in the first mode in a case where image formation with less than the predetermined reference image amount is continuously effected during a second predetermined image forming number is smaller than a number of times of the operations executed in the second mode in a case where image formation with equal or more than the predetermined reference image amount is continuously effected during the second predetermined image forming number.

15. An image forming apparatus according to claim 14, wherein the first reference value is larger than the second reference value.

16. An image forming apparatus according to claim 14, wherein the controller is capable of executing the operation in the first mode when an integrated value calculated from a value by which the value corresponding to the image amount per image exceeded the first reference value reaches a first predetermined value, and executing the operation in the second mode when the integrated value calculated from a value by which the value corresponding to the image amount per image exceeded the second reference value reaches a second predetermined value.

17. An image forming apparatus according to claim 16, wherein the first predetermined value is the same as the second predetermined value.

18. An image forming apparatus according to claim 16, wherein the integrated value is reset after the integrated value reaches the first or second predetermined value.

19. An image forming apparatus according to claim 14, wherein a calculated method using the value corresponding to the image amount per image and the first reference value is the same as a calculated method using the value corresponding to the image amount per image and the second reference value.

20. An image forming apparatus comprising:

an image bearing member;

a developing device configured to develop, with toner, an electrostatic latent image formed on said image bearing member; and a controller capable of executing an operation in a forced consumption mode in which the toner, with which the electrostatic latent image is developed on said image bearing member by said developing device, is consumed without being transferred onto a recording material, wherein the controller is capable of executing the operation in a first mode of the forced consumption mode based on a value corresponding to an image amount which is a video count value per image and a first reference value corresponding to the image amount per image when an average image amount per predetermined image forming number or per predetermined driving time of said developing device is less than a predetermined reference image amount, and executing the operation in a second mode of the forced consumption mode based on the value corresponding to the image amount per image and a second reference value corresponding to the image amount per image and different from the first reference value when the average image amount is not less than the predetermined reference image amount, and wherein the first reference value is larger than the second reference value.

21. An image forming apparatus according to claim 20, wherein the controller is capable of executing the operation in the first mode when an integrated value calculated from a value by which the value corresponding to the image amount per image exceeded the first reference value reaches a first predetermined value, and executing the operation in the second mode when the integrated value calculated from a value by which the value corresponding to the image amount per image exceeded the second reference value reaches a second predetermined value.

22. An image forming apparatus according to claim 21, wherein the first predetermined value is the same as the second predetermined value.

23. An image forming apparatus according to claim 21, wherein the integrated value is reset after the integrated value reaches the first or second predetermined value.

24. An image forming apparatus according to claim 20, wherein a calculated method using the value corresponding to the image amount per image and the first reference value is the same as a calculated method using the value corresponding to the image amount per image and the second reference value.

25. An image forming apparatus capable of executing a continuous image forming job for continuously forming an image on a plurality of recording materials comprising:

an image bearing member;

a developing device configured to develop, with toner, an electrostatic latent image formed on said image bearing member; and a controller capable of interrupting the continuous image forming job and executing an operation in a forced consumption mode in which the toner, with which the electrostatic latent image is developed on said image bearing member by said developing device, is consumed without being transferred onto the recording material, wherein said controller executes the operation in the forced consumption mode during a first period when an amount of toner consumed by forming the image on a first number of the recording materials more than a second number is smaller than a predetermined amount in the continuous image forming job, and during a second period when an amount of toner consumed by forming the image on the first number of the recording materials is equal to or larger than the predetermined amount in the continuous image forming job, and wherein said controller executes the operation in the forced consumption mode so that a frequency of execution of the operation in a case where the amount of toner consumed by forming the image on the second number of recording materials is a predetermined amount during the second period becomes lower than that during the first period.

26. An image forming apparatus according to claim 25, wherein the first number is not less than 3600 and less than 6000.

27. An image forming apparatus capable of executing a continuous image forming job for continuously forming an image on a plurality of recording materials comprising:

an image bearing member;

a developing device configured to develop, with toner, an electrostatic latent image formed on said image bearing member; and a controller capable of interrupting the continuous image forming job and executing an operation in a forced consumption mode in which the toner, with which the electrostatic latent image is developed on said image bearing member by said developing device, is consumed without being transferred onto the recording material, wherein said controller executes the operation in the forced consumption mode during a first period when an amount of toner consumed by forming the image on the recording materials in a first driving time of said developing device longer than a second driving time of said developing device is smaller than a predetermined amount in the continuous image forming job, and during a second period when an amount of toner consumed by forming the image on the recording materials in the first driving time is equal to or larger than the predetermined amount in the continuous image forming job, and wherein said controller executes the operation in the forced consumption mode so that a frequency of execution of the operation in a case where the amount of toner consumed by forming the image on the recording materials in the second driving time is a predetermined amount during the second period becomes lower than that during the first period.

28. An image forming apparatus capable of executing a continuous image forming job for continuously forming an image on a plurality of recording materials comprising:

an image bearing member;

a developing device configured to develop, with toner, an electrostatic latent image formed on said image bearing member; and a controller capable of interrupting the continuous image forming job and executing an operation in a forced consumption mode in which the toner, with which the electrostatic latent image is developed on said image bearing member by said developing device, is consumed without being transferred onto the recording material, wherein said controller executes the operation in the forced consumption mode during a first period after an image formation recording material number from an initial state of said developing device reaches a first number more than a second number in the continuous image forming job, and during a second period until the image formation recording material number from the initial state of said developing device reaches the first number in the continuous image forming job, and wherein said controller executes the operation in the forced consumption mode so that a frequency of execution of the operation in a case where the amount of toner consumed by forming the image on the second number of recording materials is a predetermined amount during the second period becomes lower than that during the first period.

29. An image forming apparatus according to claim 28, wherein the first number is not less than 3600 and less than 6000.

30. An image forming apparatus capable of executing a continuous image forming job for continuously forming an image on a plurality of recording materials comprising:

an image bearing member;

a developing device configured to develop, with toner, an electrostatic latent image formed on said image bearing member; and a controller capable of interrupting the continuous image forming job and executing an operation in a forced consumption mode in which the toner, with which the electrostatic latent image is developed on said image bearing member by said developing device, is consumed without being transferred onto the recording material, wherein said controller executes the operation in the forced consumption mode during a first period after a driving time of said developing device from an initial state of said developing device reaches a first driving time more than a second driving time in the continuous image forming job, and during a second period until the driving time of said developing device from the initial state of said developing device reaches the first driving time in the continuous image forming job, and wherein said controller executes the operation in the forced consumption mode so that a frequency of execution of the operation in a case where the amount of toner consumed by forming the image on the recording materials in the second driving time is a predetermined amount during the second period becomes lower than that during the first period.

31. An image forming apparatus capable of executing a continuous image forming job for continuously forming an image on a plurality of recording materials comprising:

an image forming portion including an image bearing member and a developing device configured to develop, with toner, an electrostatic latent image formed on said image bearing member; and a controller capable of interrupting the continuous image forming job and causing said image forming portion to execute an operation in a toner supply mode in which the toner, with which the electrostatic latent image is developed on said image bearing member by said developing device, is supplied to said image bearing member in a state in which the continuous image forming job is interrupted, wherein said controller causes said image forming portion to execute the operation in the toner supply mode based on information on an amount of toner consumed by forming the image on the recording materials in the continuous image forming job, and wherein in the continuous image forming job of a predetermined number, said controller causes said image forming portion to execute the operation in the toner supply mode during a first period after a number of recording materials on which an image is formed from an initial state of said developing device reaches a first number more than a second number and until the number of recording materials on which an image is formed reaches the predetermined number, and during a second period until the number of recording materials on which an image is formed from the initial state of said developing device reaches the first number, and wherein in the continuous image forming job of the predetermined number, said controller causes said image forming portion to execute the operation in the toner supply mode so that a frequency of execution of the operation in a case where the amount of toner consumed by forming the image on the second number of recording materials is a predetermined amount during the second period becomes lower than that during the first period.

32. An image forming apparatus according to claim 31, wherein the first number is not less than 3600 and less than 6000.

* * * * *